US006507315B2

(12) United States Patent
Purdy et al.

(10) Patent No.: US 6,507,315 B2
(45) Date of Patent: Jan. 14, 2003

(54) SYSTEM AND METHOD FOR EFFICIENTLY CHARACTERIZING THE ELEMENTS IN AN ARRAY ANTENNA

(75) Inventors: Daniel S. Purdy, Falls Church, VA (US); Jeffrey M. Ashe, Gloversville, NY (US); Erik Lier, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/848,063

(22) Filed: May 3, 2001

(65) Prior Publication Data

US 2002/0171583 A1 Nov. 21, 2002

(51) Int. Cl.[7] ..... H01Q 3/02
(52) U.S. Cl. ..... 342/374; 342/174; 342/360
(58) Field of Search ..... 342/165, 174, 342/372, 374, 373, 360

(56) References Cited

U.S. PATENT DOCUMENTS 6,084,545 A 7/2000 Lier et al.
6,163,296 A 12/2000 Lier et al.

OTHER PUBLICATIONS

Purdy, Daniel S. "An Automated Process for Efficiently Measuring the Patterns of All Elements Located in a Phased–Array Antenna" 2000 IEEE International Conference on Phased Array Systems and Technology, May 2000, pp. 521–524.

Purdy, Daniel S. and Anthony Jacomb–Hood, "In Orbit Active Array Calibration for NASA's LightSAR" IEEE, 1999, pp. 172–176.

Silverstein, Seth D. "Application of Orthogonal Codes to the Calibration of Active Phased Array Antennas for Communication Satellites" IEEE, 1997, pp. 206–218.

Skolnik, Merrill I. "Radar Handbook" McGraw–Hill Publishing, New York, 1990, pp. 7.1, 7.35–7.36.

Mailloux, Robert J. "Phased Array Antenna Handbook" Artech House, Boston, 1993, pp. 63–68.

*Primary Examiner*—Thomas H. Tarcza
*Assistant Examiner*—Fred H Mull
(74) *Attorney, Agent, or Firm*—Scully, Scott, Murphy & Presser

(57) ABSTRACT

A system and method to individually characterize all of the antenna elements or amplifiers in an array antenna system simultaneously, without the need to perform sequential measurements. A positioning device allows movement of the antenna with respect to a calibration probe or movement of the calibration probe with respect to the antenna. Multiple simultaneous control circuit encoding (CCE) measurements of each of the array elements in an array antenna are performed. A second aspect of the system and method involves changes in the level of signals transmitted by the amplifiers in the elements of an array antenna system in conjunction with the use of orthogonal coding measurements. Changes in the level of signals transmitted permits simultaneous measurement of the amplifier characteristics of each of the array elements in an array antenna.

36 Claims, 15 Drawing Sheets

Plot of Probe-Element Product, Element #9

Plot of Probe-Element Product, Element #1

Plot of Probe-Element Product, All 16 Elements

AM/AM Curves Extracted Using CCE

SYSTEM AND METHOD FOR EFFICIENTLY CHARACTERIZING THE ELEMENTS IN AN ARRAY ANTENNA

BACKGROUND OF THE INVENTION

The present invention relates to array antennas and more specifically to characterization of element patterns and amplifier characteristics in array antennas.

In an array antenna, an "active element" immersed in an array environment will behave differently from the case where the antenna element is removed from the array. This problem arises from mutual coupling between the antenna elements. Therefore if one is to have an accurate model for predicting its performance, the antenna element must be measured when the antenna element is placed in the array environment. In the prior art, the process is typically done by applying a source to the "active element," terminating the rest of the array elements, and then measuring the given active antenna element pattern.

Using the method of the prior art, single element pattern characterization measurements are used to determine each of the antenna element patterns. For an array of N elements, this is accomplished by exciting one array element and terminating all other N−1 array elements, such that only the desired array element is radiating energy. Only one of N array elements is measured at a time. Therefore, this is called the single antenna element approach. Using the single antenna element approach, all N antenna elements are measured sequentially. This process can be used to measure any array element pattern with the array element immersed in the array environment, which is, in general, different from an isolated array element, thus accounting for the mutual coupling interactions among array elements.

One problem with the prior art approach is that it is very time consuming since antenna elements are measured sequentially and the positioner will be required to go through the desired movement cycle once for each active array element. This is extremely inefficient and impractical when the positioner movement and data acquisition cycle must be repeated N times. A second disadvantage is that, in some cases, it may be difficult, impractical, or impossible to shut off all but one array element in the array under test. Removing signals from all but one array element may become a time consuming and expensive process, involving removal of a cable and replacement with a termination. If one is to rely on turning antenna elements off using digitally controlled radio frequency (RF) on/off switches, RF isolation may not be sufficient to allow for measurements to be performed to a suitable level of accuracy.

In a similar problem, the characterization of the amplitude and phase of each antenna element against signal level, frequency, and ambient temperature is crucial to create "look-up" calibration tables. This is particularly important in multi-beam active array antennas to characterize the non-linear behavior of the amplifiers, and to compare them with theoretical models such as the Shimbo model; see O. Shimbo, "Transmission Analysis in Communication Systems," Computer Science Press (1988). The current technique is to characterize each antenna element one at a time by disconnecting, turning off, or attenuating the other elements in the array. This is again the single antenna element approach so the technique is very time consuming, and therefore results in high parts integration and test time, which in turn adversely impacts the total assembly costs.

To further illustrate the limitations of the prior art, active phased-array antennas typically have a requirement to determine array element patterns while the antenna element is in the array environment. These data are needed for scaling factor constants which take into account that the antenna elements are at different distances from the calibration probe. The scaling factor constants are used in the near-field calibration system described in U.S. Pat. No. 6,084,545, issued Jul. 4, 2000 in the name of Lier et al. to take control circuit encoding (CCE) measurements of each of the array elements in an array antenna; see U.S. Pat. No. 5,572,219, issued Nov. 5, 1996 in the name of Silverstein et al. In other applications, accurate element patterns are needed for in-orbit far-field calibration where measurements of the main beam and sidelobes are taken for remote sensing of aperture deformation. For an array of 1000 elements, to efficiently obtain array element patterns for all the array elements, while the array elements are immersed in the array environment, 1000 cables must be disconnected and reconnected, the antenna rotated on a point, either spherical or planar, and the probe moved over the desired positioning range 1000 different times. This is a very time consuming and expensive process.

It can be understood then that the processes for measuring array element patterns and amplifier characteristics must be repeated for each of the array elements in the array antenna. The methods using the prior art are costly and inefficient since they are limited to measurements of a single array element at a time. Therefore, there is a need for performing antenna element pattern and amplifier characteristic measurements in a factory or diagnostic setting that allows all antenna elements and amplifiers to be characterized in an accurate, efficient and cost-effective way.

SUMMARY OF THE INVENTION

The system and method of the present invention described herein discloses a positioning device which allows movement of the antenna with respect to a calibration probe or movement of the calibration probe with respect to the antenna. It is the intermittent movement of the antenna and probe with respect to each other between measurement cycles which significantly improves implementation of the calibration procedure by permitting multiple simultaneous control circuit encoding (CCE) measurements of each of the array elements in an array antenna. The method is demonstrated experimentally using a near-field probe positioner to rapidly measure all 16 element patterns in a 2×8 array of horns.

Similarly, the system and method of the present invention described herein discloses changes in the level of signals transmitted by the amplifiers in the elements of an array antenna system in conjunction with the use of orthogonal coding measurements. Changes in the level of signals transmitted significantly improves implementation of the process of determining amplifier characteristics by permitting simultaneous measurement of the amplifier characteristics of each of the array elements in an array antenna.

The present invention comprises a system for characterizing the patterns of a plurality of elements located in an array antenna, with each of the plurality of elements including at least one of (either or both) a phase shifter and an amplitude attenuator. The antenna includes a signal port for each individual beam which the array antenna generates, and a control signal input port to which control signals are applied for control of the phase shifters and amplitude attenuators. A plurality of antenna elements comprise a beamformer, a plurality of beamformers form the array antenna. The system for characterizing the patterns of a plurality of elements located in the array antenna system comprises: a probe positioned within the field of the array antenna, and positioning means for changing the relative position and orientation between the probe and the antenna. The system also includes a calibration radio-frequency source which is (a) coupled to at least one of the signal-ports of the array antenna when the array antenna is oriented as a transmit antenna, and (b) coupled to the probe when the array antenna is oriented as a receive antenna, with the calibration radio-frequency source generating a calibration signal. An orthogonal code generating means is applied to a plurality of antenna elements of at least one of the beamformers to sequentially set at least one of the phase shifters and amplitude attenuators (either one or both) with a plurality of sets of values. Each of the sets of values imposes a coding on the calibration signal to thereby sequentially generate calibration signals encoded with sets of values. Each set of values so encoded onto the calibration signals is orthogonal to other sets of values with which the calibration signals are encoded. When the array antenna is oriented as a transmit antenna, the probe receives the calibration signals sequentially encoded with mutually orthogonal values, and when the array antenna is oriented as a receive antenna, the calibration signals sequentially encoded with mutually orthogonal values are generated at least one of the signal ports of the array antenna. The system also includes a coherent radio-frequency receiver, a decoder for decoding signals encoded with the mutually orthogonal values, for generating decoded signals and means for coupling the encoded signals to the decoder, as a result of which the decoder generates the decoded signals. A processor is coupled to the decoder for processing the decoded signals for generating signals representing at least the values of one of phase shift and attenuation, or both if appropriate. The coupling means is coupled to the processor and to at least one of the phase shifters and the amplitude attenuators, for coupling to the signals representing at least the values of one of phase shift and attenuation. The system includes also a recorder for recording the signals representing at least the values of one set of probe-element positions and orientations and element characterization patterns; and an antenna controller for controlling the relative position between the probe and the antenna and for controlling the orthogonal code generating means. The probe is positioned typically at a position fixed relative to the array antenna. The position corresponds essentially to the boresight position of, and in front of, any one of the plurality of antenna elements by positioning means for changing the position of the probe relative to the array antenna by rotation of the array antenna around a vertical axis which is either coincident with the centerline of the probe, or parallel to the centerline of the probe. The present invention includes also a method of individually characterizing any or all of the antenna elements in an array antenna system simultaneously, without the need of performing sequential measurements, using the aforementioned system.

Another aspect of the present invention comprises a system for determining the characteristics of a plurality of amplifiers in an array antenna, with each amplifier coupled to an element located in the array antenna therein forming a plurality of elements, and each of the plurality of elements including at least one of (either one or both) a (a) phase shifter and (b) amplitude attenuator. The array antenna includes a beam port for each individual beam which the antenna generates, and a control signal input port to which control signals are applied for control of the phase shifters and amplitude attenuators. A plurality of antenna elements comprise a beamformer, and a plurality of beamformers forms the array antenna. The system for determining the characteristics of a plurality of amplifiers located i n the array antenna system comprises e a probe positioned at a distance fixed relative to the array antenna and within the field of the array antenna, and means for changing the strength level of signals applied to a plurality of amplifiers located in the array antenna. The system includes a calibration radio-frequency source, with the calibration radio-frequency source being (a) coupled to at least one of the signal ports of the array antenna when the array antenna is oriented as a transmit antenna, and (b) coupled to the probe when the array antenna is oriented as a receive antenna The system further comprises a calibration radio-frequency source generating a calibration signal; a calibration encoding means applied to a plurality of the antenna elements corresponding to any one of the beamformers for sequentially setting at least one of the phase shifters and the amplitude attenuators with a plurality of sets of values. Each of the sets of values imposes a coding on the calibration signal to thereby sequentially generate calibration signals encoded with sets of values. Each set of values so encoded onto the calibration signals is orthogonal to other sets of values with which the calibration signals are encoded, whereby, when the array antenna is oriented as a transmit antenna, the probe receives the calibration signals sequentially encoded with mutually orthogonal values, and when the array antenna is oriented as a receive antenna, the calibration signals sequentially encoded with mutually orthogonal values are generated at least one of the signal ports of the array antenna. The system includes also a coherent radio-frequency receiver; a decoder for decoding signals encoded with the mutually orthogonal values, for generating decoded signals therefrom; and encoded signal coupling means for coupling the encoded signals to the decoder, as a result of which the decoder generates the decoded signals. A processor is coupled to the decoder, for processing the decoded signals for generating signals representing at least the values of one of phase shift and attenuation, and coupling means are coupled to the processor and to at least one of the phase shifters and the amplitude attenuators, for processing the decoded signals for generating signals representing at least the values of at least one set of signal levels and amplifier characteristics. The system includes also a recorder for recording the signals representing at least the values of one set of probe element positions and orientations and amplifier characteristics; and an antenna controller for controlling the signal level changing means and the calibration encoding means. The probe is positioned at a position corresponding essentially to the boresight position of, and in front of, any one of the plurality of antenna elements. The amplifier system properties which can be determined include the output signal amplitude compared to the input signal amplitude and the relative phase between the output signal and the input signal. The present invention includes also method of individually characterizing any or all of the amplifier characteristics, such as output signal amplitude and phase versus input signal amplitude of amplifiers corresponding to a plurality of array elements in an array antenna system simultaneously, without the need of performing sequential measurements, using the aforementioned system.

In the method for characterizing the patterns of a plurality of elements located in an array antenna, each of the plurality of elements includes at least one of a (a) phase shifter and an (b) amplitude attenuator. The array antenna includes a signal port for each individual beam which the array antenna generates, and a control signal input port to which control signals are applied for control of the phase shifters and amplitude attenuators. A plurality of elements therein comprises a beamformer, and a plurality of beamformers forms the array antenna. The method for characterizing the patterns of a plurality of elements located in the array antenna comprises the steps of: positioning a probe within the field of the array antenna, with the probe and the array antenna fixed in position relative to each other; generating a calibration signal by means of a calibration radio-frequency source, the calibration radio-frequency source being (a) coupled to at least one of the signal-ports of the array antenna when the array antenna is oriented as a transmit antenna, and (b) coupled to the probe when the array antenna is oriented as a receive antenna; applying an orthogonal code generating means to a plurality of the antenna elements of the array antenna for sequentially setting at least one of the (a)phase shifters and (b)amplitude attenuators with a plurality of sets of values, each of the sets of values imposing a coding on the calibration signal to thereby sequentially generate calibration signals encoded with sets of values, each set of values so encoded onto the calibration signals being orthogonal to other sets of values with which the calibration signals are encoded, whereby, when the array antenna is oriented as a transmit antenna, the probe receives the calibration signals sequentially encoded with mutually orthogonal values, and when the array antenna is oriented as a receive antenna, the calibration signals sequentially encoded with mutually orthogonal values are generated at least one of the signal ports of the array antenna; receiving the calibration signals sequentially encoded with mutually orthogonal values by means of a coherent radio-frequency receiver; decoding signals encoded with the mutually orthogonal values by means of a decoder for generating decoded signals therefrom; coupling the encoded signals to the decoder as a result of which the decoder generates the decoded signals; processing by means of a processor coupled to the decoder the decoded signals for generating signals representing at least the values of one of phase shift and attenuation; coupling to the signals representing at least the values of one of phase shift and attenuation by coupling means coupled to the processor and to at least one of the phase shifters and the amplitude attenuators; recording the signals representing at least the values of one set of probe-element positions and element characterization patterns by means of a recorder; and controlling by means of an antenna controller the relative position between the probe and the antenna, and the orthogonal code generating means. The method includes using orthogonal coding to perform simultaneous measurements comprising at least one of (a) phase angles, and (b) amplitude levels of the phase shifters and attenuators of the plurality of elements corresponding to the array antenna; changing the relative position between the probe and the array antenna to a plurality of positions; using orthogonal coding to perform simultaneous recorded measurements comprising at least one of (a) phase angles and (b) amplitude levels of the plurality of elements at each of the plurality of positions in the array antenna; scaling the measurements of the relative probe element-probe positions by compensating for the pattern inherent to the probe, and recovering element patterns versus element-probe positions to characterize the patterns of elements of the array antenna.

In the method for determining the characteristics of a plurality of amplifiers in an array antenna, each amplifier is coupled to an element located in the array antenna therein forming a plurality of elements. Each of the plurality of elements includes at least one of a (a) phase shifter and an (b) amplitude attenuator, in which the array antenna includes a beam port for each individual beam which said antenna generates, and a control signal input port to which control signals are applied for control of said phase shifters and amplitude attenuators. A plurality of elements comprises a beamformer and a plurality of beamformers forms the array antenna. The method for determining the characteristics of a plurality of amplifiers located in the array antenna comprises the steps of: positioning a probe at a distance fixed relative to the array antenna, with the probe being within the field of the array antenna; applying a signal to a plurality of amplifiers located in any one of the beamformers of the array antenna; generating a calibration signal by means of a calibration radio-frequency source, the calibration radio-frequency source being (a) coupled to at least one of the signal ports of the array antenna when the array antenna is oriented as a transmit antenna, and (b) coupled to said probe when the array antenna is oriented as a receive antenna; applying an orthogonal code generating means to a plurality of the antenna elements corresponding to any one of the beamformers for sequentially setting at least one of the (a) phase shifters and (b) amplitude attenuators with a plurality of sets of values, each of the sets of values imposing a coding on the calibration signal to thereby sequentially generate calibration signals encoded with sets of values, each set of values so encoded onto said calibration signals being orthogonal to other sets of values with which the calibration signals are encoded, whereby, when the array antenna is oriented as a transmit antenna, the probe receives the calibration signals sequentially encoded with mutually orthogonal values and when the array antenna is oriented as a receive antenna, the calibration signals sequentially encoded with mutually orthogonal values are generated at least one of the signal ports of the array antenna; and receiving the calibration signals sequentially encoded with mutually orthogonal values by means of a coherent radio-frequency receiver. The method includes decoding by means of a decoder signals encoded with the mutually orthogonal values, for generating decoded signals therefrom; coupling by encoded signal coupling means the encoded signals to the decoder, as a result of which the decoder generates the decoded signals; processing by means of a processor coupled to the decoder the decoded signals for generating signals representing at least the values of one of phase shift and attenuation; coupling to the processor and to at least one of the phase shifters and the amplitude attenuators, for processing the decoded signals for generating signals representing at least the values of at least one set of signal levels and amplifier characteristics; recording by means of a recorder the signals representing at least the values of one set of probe element positions and orientations and amplifier characteristics; and controlling by means of an antenna controller the signal level changing means and the orthogonal code generating means. The method includes, in the case of a transmit antenna, setting the strength of the encoding signal to a plurality of signal input ports of the array antenna; in the case of a receive antenna, setting the strength of the encoding signal to the probe; using the orthogonal coding to perform simultaneous measurements comprising at least one of phase shift and attenuation of each amplifier corresponding to the plurality of elements in the array antenna; changing the signal strength levels to a plurality of signal strength levels; inserting recorded measurements of the input signal levels into the processor; and recovering recorded output signal levels versus input signal levels from the processor to determine the characteristics of a plurality of amplifiers in an array antenna.

BRIEF DESCRIPTION OF THE DRAWFNGS

DETAILED DESCRIPTION OF EXEMPLARY EMBODIMENTS

In one embodiment, the system and method individually characterize any or all of the antenna elements in an array antenna system simultaneously, without the need to perform sequential measurements. In another embodiment, the system and method individually characterize any or all of the amplifier characteristics, such as output signal amplitude and phase versus input signal amplitude of amplifiers corresponding to a plurality of array elements in an array antenna system simultaneously, without the need to perform sequential measurements. Functional schematic block diagrams of the apparatus hardware are shown in FIGS. 1A, 1B, 1C, 1D, 1E and 1F and simplified flow charts of the method are shown in FIGS. 2A, 2B, 2C and FIG. 3.

Figure 1A:
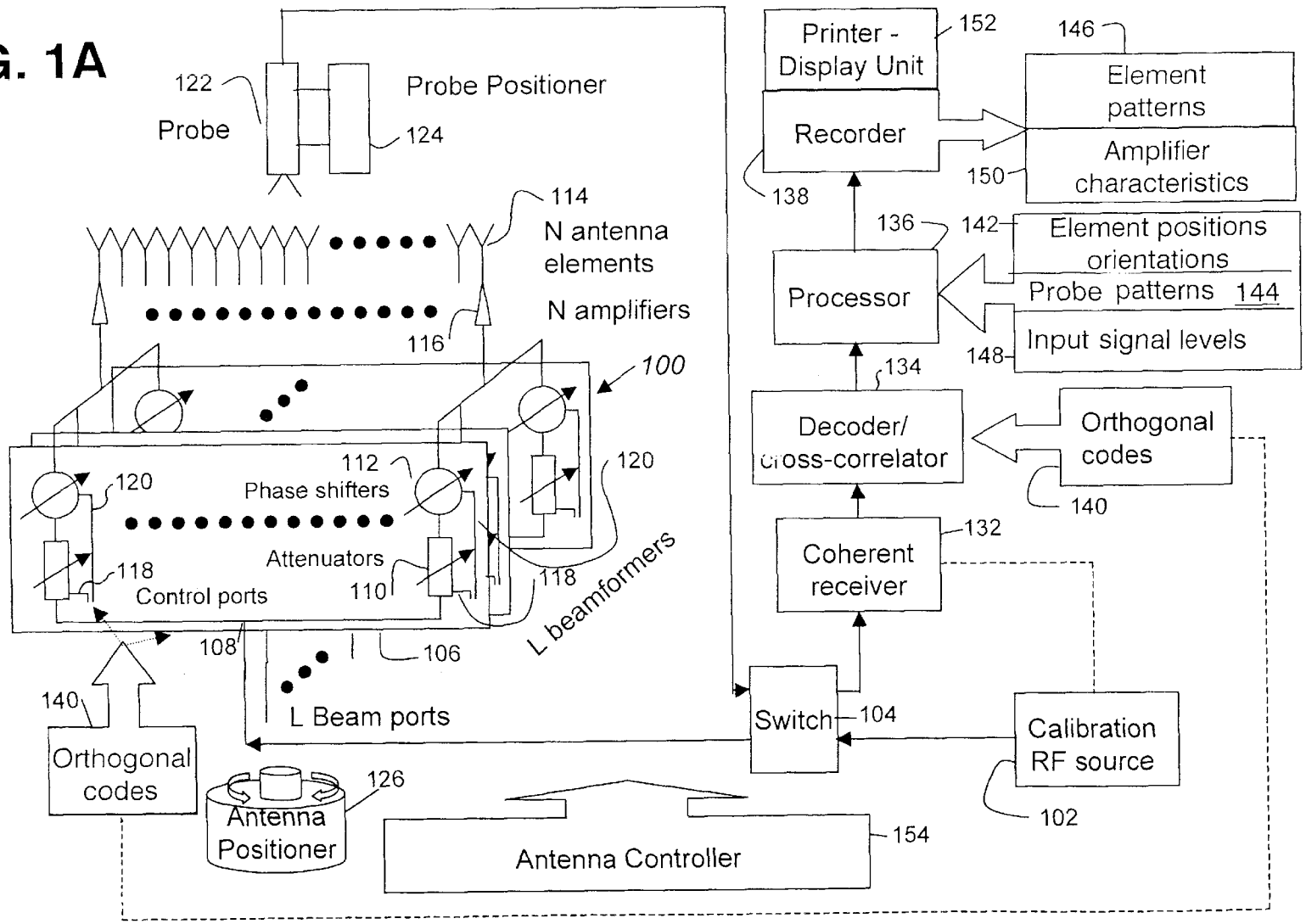
FIG. 1A is a schematic block diagram of an embodiment of the present invention of a measurement system apparatus for characterizing element patterns and amplifier characteristics of an array antenna in the transmit mode where the antenna element probe is fixed and the antenna is rotated.

In FIG. 1A, the apparatus hardware is described for an array antenna 100 in the transmit test mode. In array antenna 100, in the transmission test mode, a calibration radio-frequency (RF) source 102 is coupled through optional switch 104 to the input of one of L beamformers 106. Each beamformer 106 receives a beam through individual beam ports 108 from the calibration RF source 102 to each of N attenuators 110 and N phase shifters 112, one set of one attenuator 110 and one phase shifter 112 for each of N antenna elements 114. Each set of attenuator 110 and phase shifter 112 when desired is connected to one of N amplifiers 116 common to the nth corresponding set of attenuator 110 and phase shifter 112 on each of the L beamformers 106. Each attenuator 110 is provided with its own signal control port 118. Similarly, each phase shifter 112 is provided with its own signal control port 120. Each attenuator 110 is controlled typically digitally through its signal control port 118 to permit control of the attenuator function, although other suitable methods can be employed. Similarly, each phase shifter 112 is controlled typically digitally through its signal control port 120 to permit control of the phase shifter function, although other suitable methods can be employed.

A probe 122 is located, optionally using optional probe positioner 124 at a distance d away from the antenna array elements 114, the distance d being nominally in the far-field of the antenna array elements 114. The far field distance d can be defined as $d=2D^2/\lambda$, where D is the dimension of the antenna, and $\lambda$ is the free-space wavelength. It is necessary to determine the far-field pattern of the antenna array elements to generate the array pattern and to avoid interaction between the antenna elements and the probe.

In FIG. 1A, the probe 122 is fixed in position and the entire antenna 100 is mounted on an antenna positioner 126 which permits rotation of the antenna 100. To obtain the best characterization of the element pattern, the antenna 100 is rotated around a selected point. For an array antenna, this is typically around its phase center which is in the center of the aperture.

In the transmit test mode, the optional transmit/reception mode switch 104 is positioned such that the beam received by the probe 122 is transmitted to a coherent RF receiver 132 that ultimately transmits the signals through decoder/cross-correlator 134 to a processor 136 and on to a recorder 138. Those skilled in the art will recognize that transmit/receive mode switch 104 is preferably electronic in nature and that the electronic signals inherent in such devices can require many separate switchable paths to accomplish the desired switching function. Alternatively, switch 104 can be omitted and the network simply arranged in the desired manner for testing in the transmit mode by setting the calibration RF source 102 to couple directly to beam port 106 and by setting the probe 122 to couple directly to the coherent RF receiver 132. The coherent RF receiver 132 is coherent with respect to the calibration RF source 102.

For a given probe position M, all of the N antenna elements 114 in a given one of the L beamformers 106 are encoded by applying a mutually orthogonal set of codes 140 thus allowing all antenna elements 114 to radiate simultaneously. Specifically, at a given moment, a calibration signal from calibration RF source 102, and the orthogonal codes 140 as suggested by Silverstein et al., are applied to all of the control signal ports 118 and 120 of a single beamformer 106. The orthogonal codes individually modulate the various phase shifters and amplitude controllers with separately identifiable codes, so that the signals applied to the various antenna elements 114 are encoded with the orthogonal codes. A mutually orthogonal code set is applied to the phase and amplitude controller corresponding to each of the elements 114. The phase and/or amplitude of each element is toggled according to the sequence that constitutes the mutually orthogonal code set, thus providing a burst of RF modulated signal with the orthogonal code sequence encoding each element signal path. Since each element signal path is modulated with a burst of RF signal containing separately identifiable orthogonal codes, the decoder/cross-correlator 134 is used to decode the RF signal propagation characteristics corresponding to each of the element RF signal paths. Since there are N antenna elements 114 in each beamformer 106 and there are L beamformers 106, there are approximately N×L bursts required. It is important to recognize that the element pattern is not a single plane pattern but generally is a two-dimensional pattern. Typically, the probe 122 takes azimuth and elevation scans.

Thus the amplitude and phase weights of the elemental signals, which can be designated $a_1e^{j\Phi 1}$, $a_2e^{j\Phi 2}$, . . . , $a_ne^{j\Phi N}$, respectively, are modulated by the various orthogonal codes. Stated in other words, the various paths between the signal input ports 118 and 120 and each of the individual antenna elements $\mathbf{114}_1$, $\mathbf{114}_2$, . . . , $\mathbf{114}_n$, . . . , $\mathbf{114}_N$ of array antenna 100 are modulated with different codes, so that a unique coding sequence is applied to each of the antenna element paths, by toggling at least one of amplitude and phase so as to provide a unique identifier for the signal path. The probe 122 receives the radiated signals from each elemental antenna $\mathbf{114}_1$, $\mathbf{114}_2$, . . . , $\mathbf{114}_n$, . . . , $\mathbf{114}_N$ of the array antenna 100 with a phase and amplitude which depends upon the separation r, between the individual antenna elements and the probe, and the angular separation as it affects the radiation patterns of the elemental antennas and the probe. The signals received by the probe 122 are applied to coherent receiver 132, and the resulting signal, which is a composite of all of the individual signals from the individual element antennas of the array 100 are applied to decoder/cross-correlator 134. Decoder/cross-correlator 134 also receives the same set of orthogonal codes 140 and performs the decoding, so that the individual element signals can be extracted from the composite signal. The resulting unprocessed signals are designated $E_1$, $E_2$, . . . , $E_n$, . . . , $E_N$. Each of these signals represents one of the signals flowing in an independent path extending between one of the various individual antenna elements $\mathbf{114}_1$, $\mathbf{114}_2$, . . . , $\mathbf{114}_n$, . . . , $\mathbf{114}_N$ of array antenna 100 and the probe 122. Consequently, the unique coding sequence applied to each of the antenna element paths allows for simultaneous measurement of all of the array elements of the phased-array antenna 100. More specifically, each of the signals has its relative amplitude and phase $a_ne^{j\Phi n}$ encoded with the orthogonal coding sequence. The procedure for using a Hadamard matrix to generate the orthogonal encoding and decoding sequences is described in the above-mentioned Silverstein et al. patent. Other orthogonal encoding and decoding sequences known in the art can be applied as well.

When characterizing the antenna element patterns 146, the processor 136 uses knowledge of relative probe-element positions and orientations 142 and the inherent known probe patterns 144 to compute the antenna element patterns 146 in the array environment, record the patterns 146 in the recorder 138 and optionally display and/or print out the antenna element patterns 146 in optional printer and/or display unit 152, for each of the positions for which the RF fields are sampled.

When determining the amplifier characteristics 150, the processor 136 uses knowledge of relative probe-element positions and orientations 142 and the input signal levels 148 to compute the amplifier characteristics 150 in the array environment, records the amplifier characteristics 150 in the recorder 138 and optionally displays and/or prints out the amplifier characteristics 150 in the optional printer and/or display unit 152, for each of the signal levels for which the RF fields are sampled with both the probe 122 and the antenna 100 being maintained at the same fixed position with respect to each other for all readings. Antenna controller 154 operates software which controls relative positions between the antenna and the probe, and which also controls the signal coding process. Those skilled in the art will recognize that antenna controller 154 comprises typically a multiplexer-type process control unit which is typically hard-wired throughout to the system apparatus hardware illustrated in FIG. 1A. Those skilled in the art will recognize that in FIG. 1A, antenna positioner 126.can be held in a fixed position for all readings, so that both the probe 122 and the antenna 100 are maintained at the same fixed position with respect to each other for all readings.

Figure 1B:
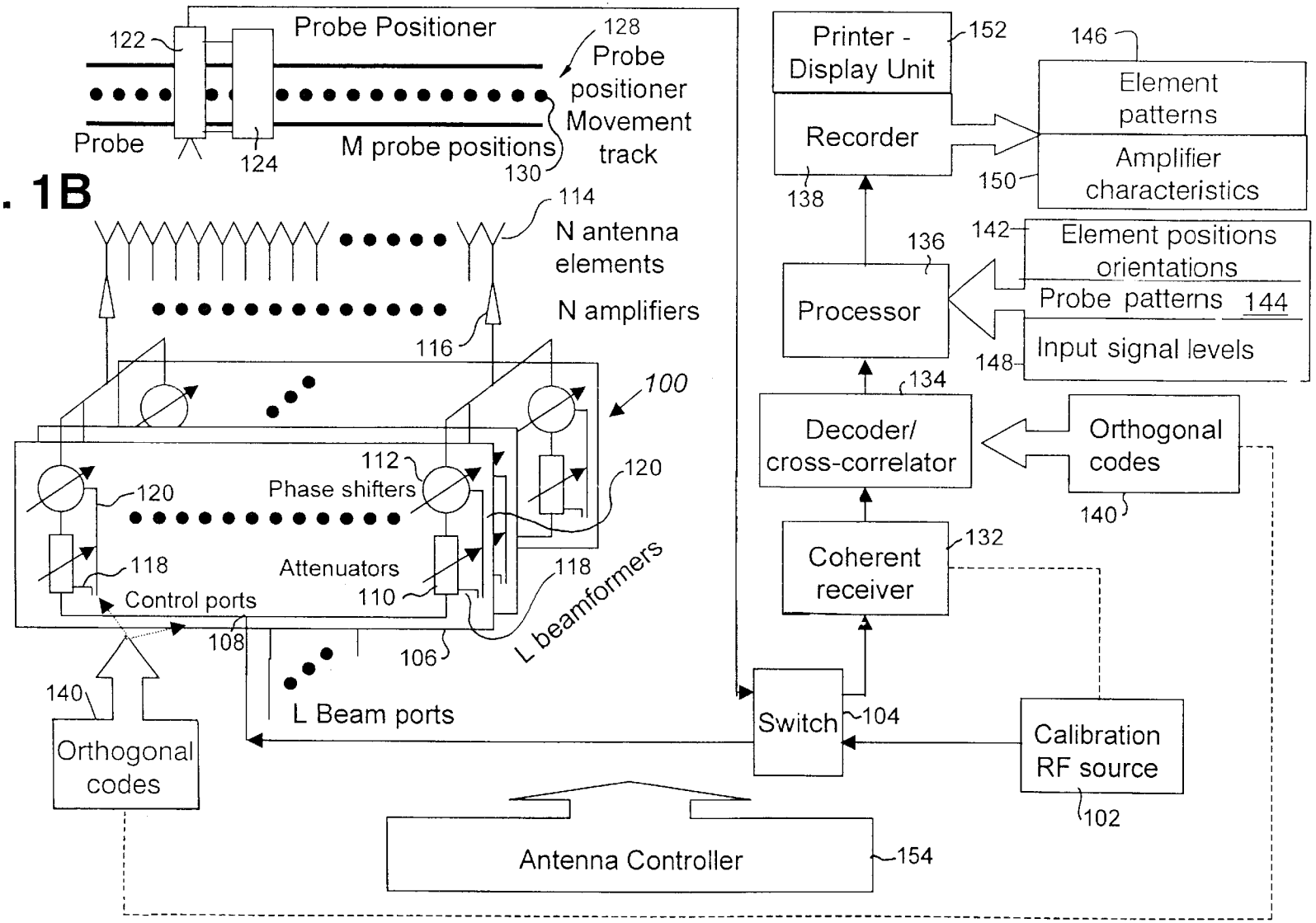
FIG. 1B is a schematic block diagram of an embodiment of the present invention of a measurement system apparatus for characterizing element patterns and amplifier characteristics of an array antenna in the receive mode where the antenna element probe is fixed and the antenna is rotated.
Figure 1C:
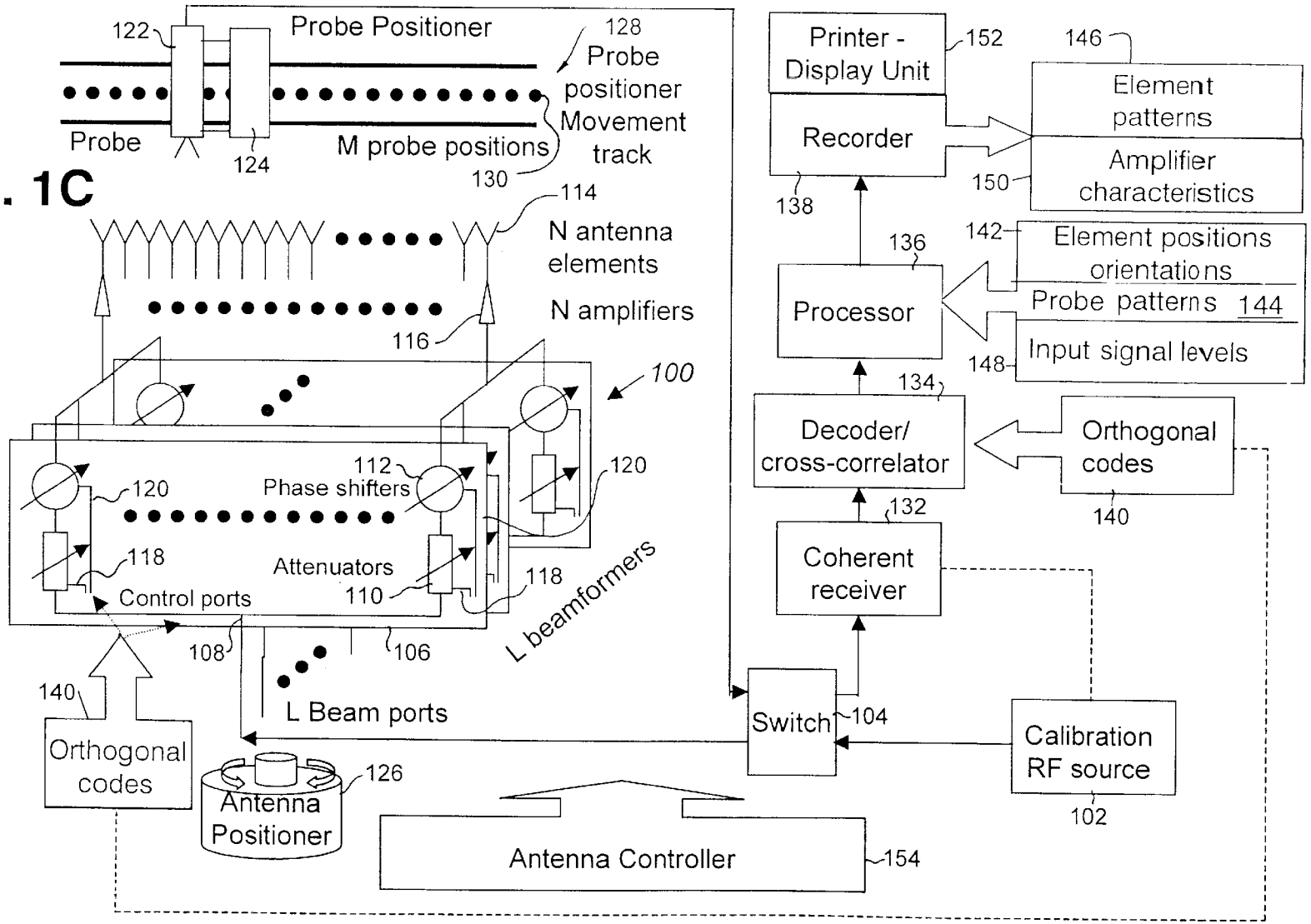
FIG. 1C is a schematic block diagram of a variation of the embodiment of the present invention of a measurement system apparatus for characterizing element patterns and amplifier characteristics of an array antenna in the transmit mode where the antenna element probe is moved and the antenna is fixed.

Referring to FIG. 1C, those skilled in the art will recognize that FIG. 1C illustrates the identical embodiment of the present invention in the transmit test mode as is illustrated in FIG. 1A except that instead of the probe 122 being fixed in position and the antenna 100 being rotated by antenna positioner 126, the probe 122 is mounted on a movement track 128 and the probe 122 is moved along the movement track 128 by probe positioner 124 to again position the probe 122 at any one of M positions 130 corresponding to the boresight position, or in the vicinity of the boresight position, of any one of N antenna elements 114.

Figure 1D:
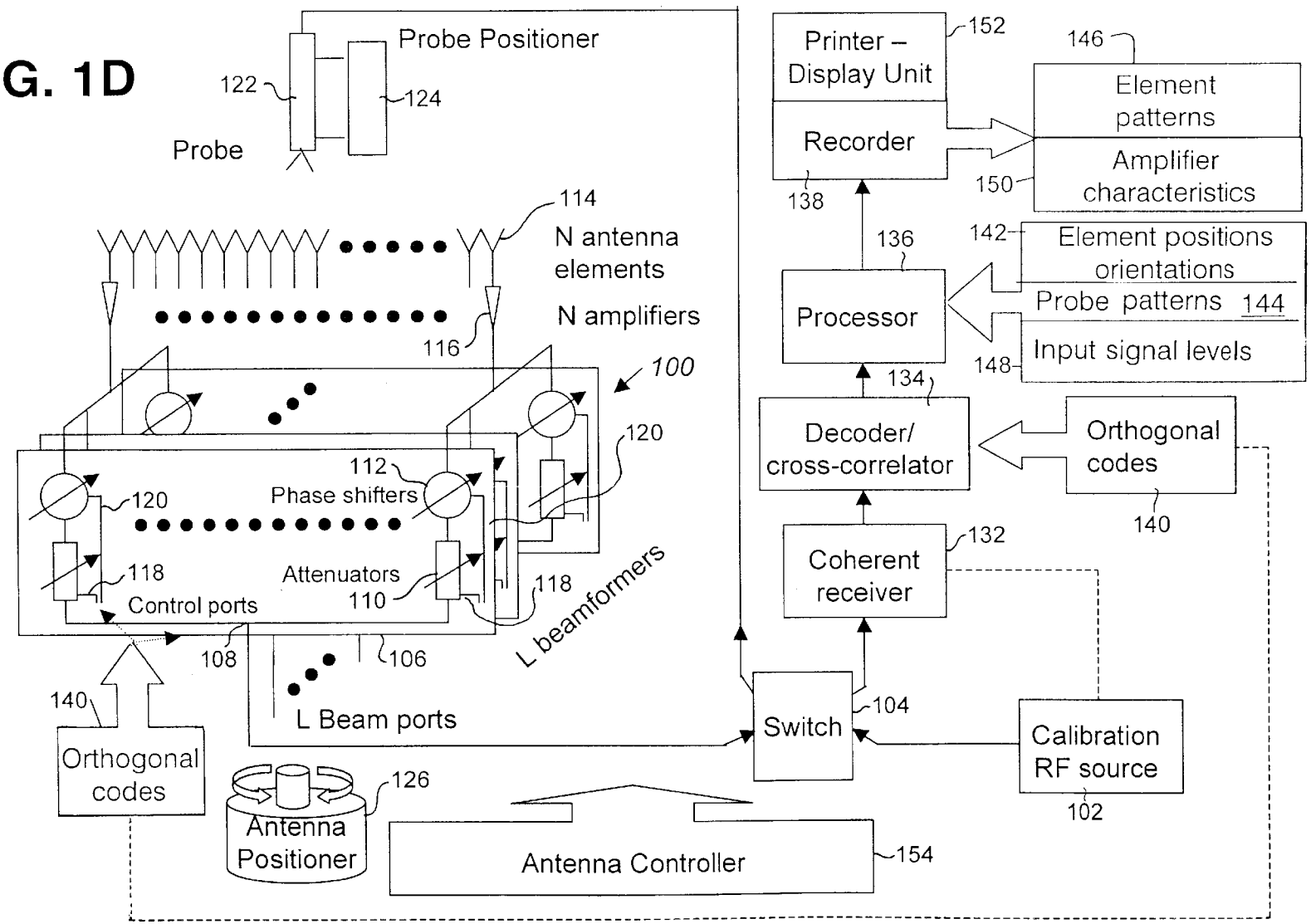
FIG. 1D is a schematic block diagram of a variation in the embodiment of present invention of a measurement system apparatus for characterizing element terns and amplifier characteristics of an array antenna in the receive mode where the antenna element probe is moved and the antenna is fixed.
Figure 1E:
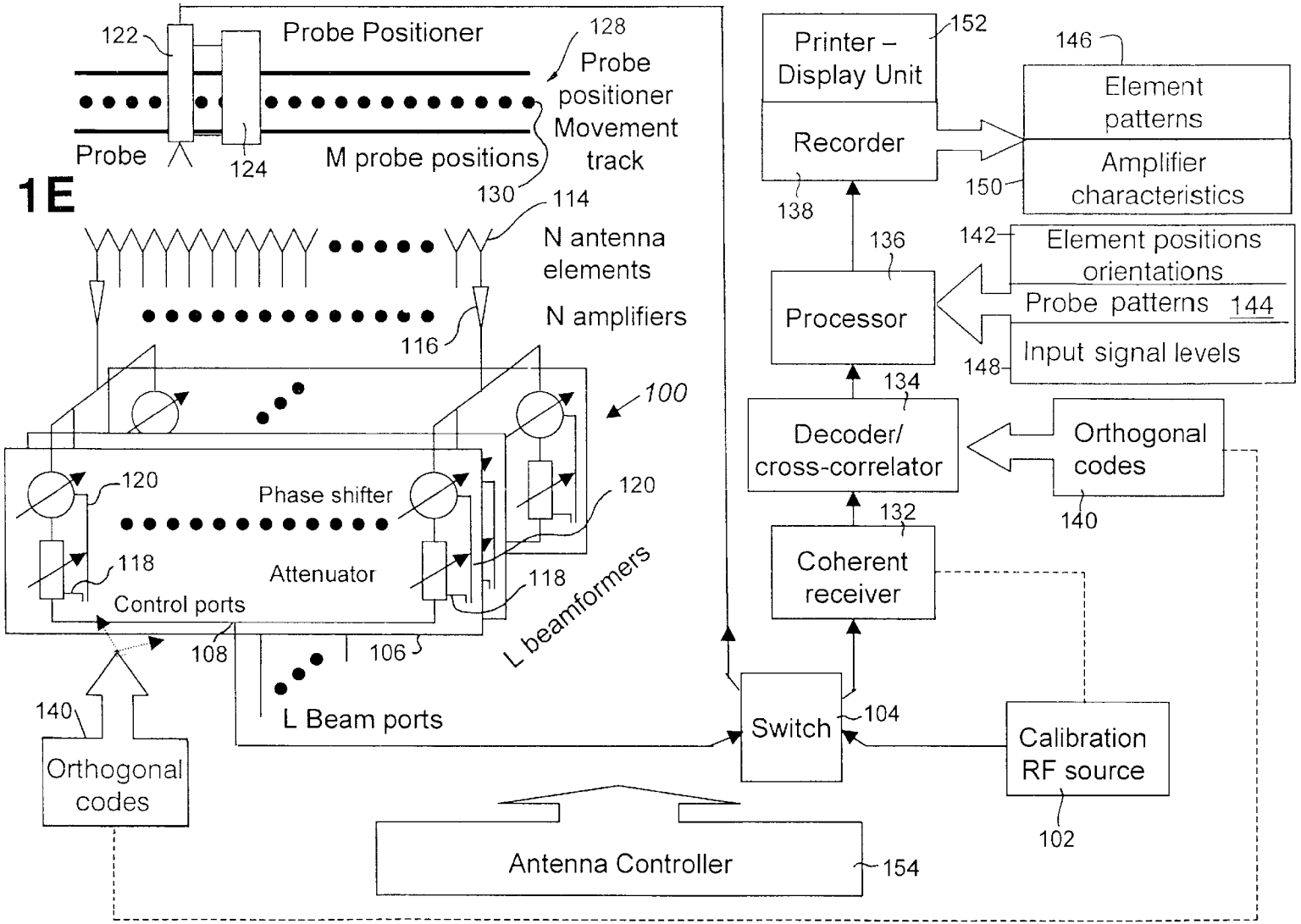
FIG. 1E is a schematic block diagram of a variation of the embodiment of e present invention of a measurement system apparatus for characterizing element patterns and amplifier characteristics of an array antenna in the transmit mode where both he antenna element probe and the antenna are moved relative to each other.

Referring to FIG. 1E, those skilled in the art again will recognize that FIG. 1E illustrates the identical embodiment of the present invention in the transmit test mode as is illustrated in FIG. 1A or FIG. 1C except that instead of the probe 122 being fixed in position and the antenna 100 being rotated by antenna positioner 126, or the probe 122 mounted on a movement track 128 and the probe 122 moved along the movement track 128 by probe positioner 124 and the antenna 100 fixed in position, both the probe 122 and the antenna 100 are capable of being moved. In FIG. 1E, the probe 122 is mounted on a movement track 128 and the probe 122 is moved along the movement track 128 by probe positioner 124. This arrangement permits both the probe 122 and the antenna 100 to be positioned at any one of M positions 130 corresponding to the boresight position, or in the vicinity of the boresight position, of any one of N antenna elements 114. With respect to FIG. 1C and FIG. 1E, movement track 128 is not limited to a linear track but can be of any shape to permit variable positioning of the probe 122, such as would be achieved with a "roller coaster" design or a spherical surface design.

In FIG. 1B, the apparatus hardware is described for an array antenna 100 in the receive test mode. When the array antenna 100 is to be tested in the receive mode. the optional transmit/receive mode switch 104, preferably electronic as described above, is positioned such that the calibration RF source 102 supplies an RF signal to the probe 122. As is the case for the transmission test mode, switch 104 can be omitted and the network simply arranged in the desired manner for testing in the reception mode by setting the calibration RF source 102 to couple directly to the probe 122 and by setting the beam port 106 to couple directly to coherent RF receiver 132. In FIG. 1B, as is the case for the transmit mode illustrated in FIG. 1A, the probe 122 is fixed in position and the entire antenna 100 is mounted on an antenna positioner 126 which permits rotation of the antenna 100. To obtain the best characterization of the element pattern, the antenna 100 is rotated around a selected point. For an array antenna, this is typically around its phase center which is in the center of the aperture.

Calibration RF source 102 transmits a calibration signal to probe 122. At the same time, the probe 122 transmits the signal received from the coherent RF source 102 to the N antenna elements 114 and the signals are transmitted through amplifiers 116, now oriented in the reverse direction as compared to the transmit test mode, and through phase shifters 112 and 110, each of which are mounted on beamformer 106. Therefore, the signal produced at the receive antenna beam port 106 is the calibration signal from calibration RF source 102 encoded or modulated with the orthogonal codes 140. The signals pass through beam port 106 and are coupled to the coherent RF receiver 132 and through the remainder of the circuit exactly as before for the transmit case described in FIG. 1A to obtain the resulting element patterns 146 or amplifier characteristics 150.

As is the case for the transmit test mode in the receive test mode, for a given probe position M, all of the N antenna elements 114 are encoded by applying a mutually orthogonal set of codes 140 thus allowing all antenna elements 114 to receive simultaneously. Again, the orthogonal codes 140 as suggested by Silverstein et al. are applied to control signal input ports 118 and 120 of all L beamformers 106. The orthogonal codes individually modulate the various phase shifters and amplitude controllers with separately identifiable codes, so that the signals applied to the various antenna elements 114 are encoded with the orthogonal codes. The orthogonal codes individually modulate the various phase shifters and amplitude controllers with separately identifiable codes, so that the signals applied to the various antenna elements 114 are encoded with the orthogonal codes. A mutually orthogonal code set is applied to the phase and amplitude controller corresponding to each of the elements 114. The phase and/or amplitude of each element is toggled according to the sequence that constitutes the mutually orthogonal code set, thus providing a burst of RF modulated signal with the orthogonal code sequence encoding each element signal path. Since each element signal path is modulated with a burst of RF signal containing separately identifiable orthogonal codes, the decoder/cross-correlator 134 is used to decode the RF signal propagation characteristics corresponding to each of the element RF signal paths. Since there are N antenna elements 114 in each beamformer 106 and there are L beamformers 106, there are approximately N×L bursts required. It is important to recognize that the element pattern is not a single plane pattern but generally is a two-dimensional pattern. Typically, the probe 122 takes azimuth and elevation scans.

As is the case for the transmit test mode, for the receive test mode, when determining the resulting antenna element patterns 146, the processor 136 uses knowledge of relative probe-element positions and orientations 142 and the known probe patterns 144 to compute the antenna element patterns 146 in the array environment, record the patterns 146 in the recorder 138 and optionally display and/or print out the antenna element patterns 146 in optional printer and/or display unit 152, for each of the positions 122 for which the RF fields are sampled Similarly, for the receive test mode, when determining the amplifier characteristics 150, the processor 136 uses knowledge of relative probe-element positions and orientations 142 and the input signal levels 148 to compute the amplifier characteristics 150 in the array environment, record the amplifier characteristics 150 in recorder 138 and optionally display and/or print out the amplifier characteristics 150 in the printer and/or display unit 152, for each of the signal levels 148 for which the RF fields are sampled with both the probe 122 and the antenna 100 being maintained at the same fixed position with respect to each other for all readings. Antenna controller 154 operates software which controls relative positions between the antenna and the probe, and which also controls the signal coding process. Those skilled in the art will recognize that antenna controller 154 comprises typically a multiplexer-type process control unit which is typically hard-wired throughout to the system apparatus hardware illustrated in FIG. 1B. Those skilled in the art will recognize that in FIG. 1B, antenna positioner 126 can be held in a fixed position for all readings, so that both the probe 122 and the antenna 100 are maintained at the same fixed position with respect to each other for all readings.

Referring to FIG. 1D, those skilled in the art will recognize that FIG. 1D illustrates the identical embodiment of the present invention in the receive test mode as is illustrated in FIG. 1B except that instead of the probe 122 being fixed in position and the antenna 100 being rotated by antenna positioner 126, the probe 122 is mounted on a movement track 128 and the probe 122 is moved along the movement track 128 by probe positioner 124 to again position the probe 122 at any one of M positions 130 corresponding to the boresight position, or in the vicinity of the boresight position, of any one of N antenna elements 114.

Figure 1F:
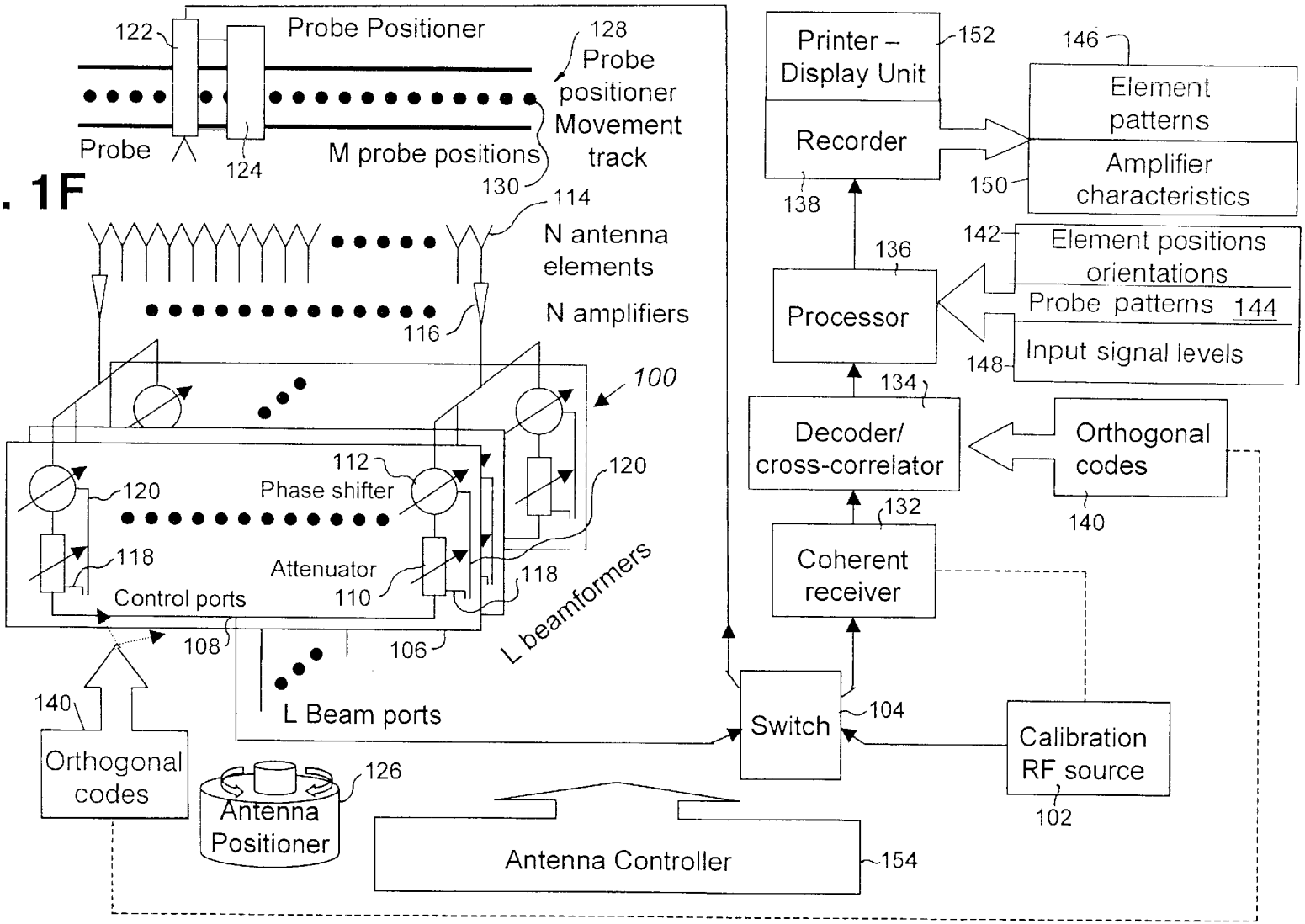
FIG. 1F is a schematic block diagram of a variation of the embodiment of the present invention of a measurement system apparatus for characterizing element patterns and amplifier characteristics of an array antenna in the receive mode where both the antenna element probe and the antenna are moved relative to each other.

Referring to FIG. 1F, those skilled in the art again will recognize that FIG. 1F illustrates the identical embodiment of the present invention in the receive test mode as is illustrated in FIG. 1B or FIG. 1D except that instead of the probe 122 being fixed in position and the antenna 100 being rotated by antenna positioner 126, or the probe 122 mounted on a movement track 128 and the probe 122 moved along the movement track 128 by probe positioner 124 and the antenna 100 fixed in position, both the probe 122 and the antenna 100 are capable of being moved. In FIG. 1F, the probe 122 is mounted on a movement track 128 and the probe 122 is moved along the movement track 128 by probe positioner 124. This arrangement permits both the probe 122 and the antenna 100 to be positioned at any one of M positions 130 corresponding to the boresight position, or in the vicinity of the boresight position, of any one of N antenna elements 114. Again, for both FIG. 1D and FIG. 1F, movement track 128 is not limited to a linear track but can be of any shape to permit variable positioning of the probe 122, such as would be achieved with a "roller coaster" design or a spherical surface design.

Figure 2A:
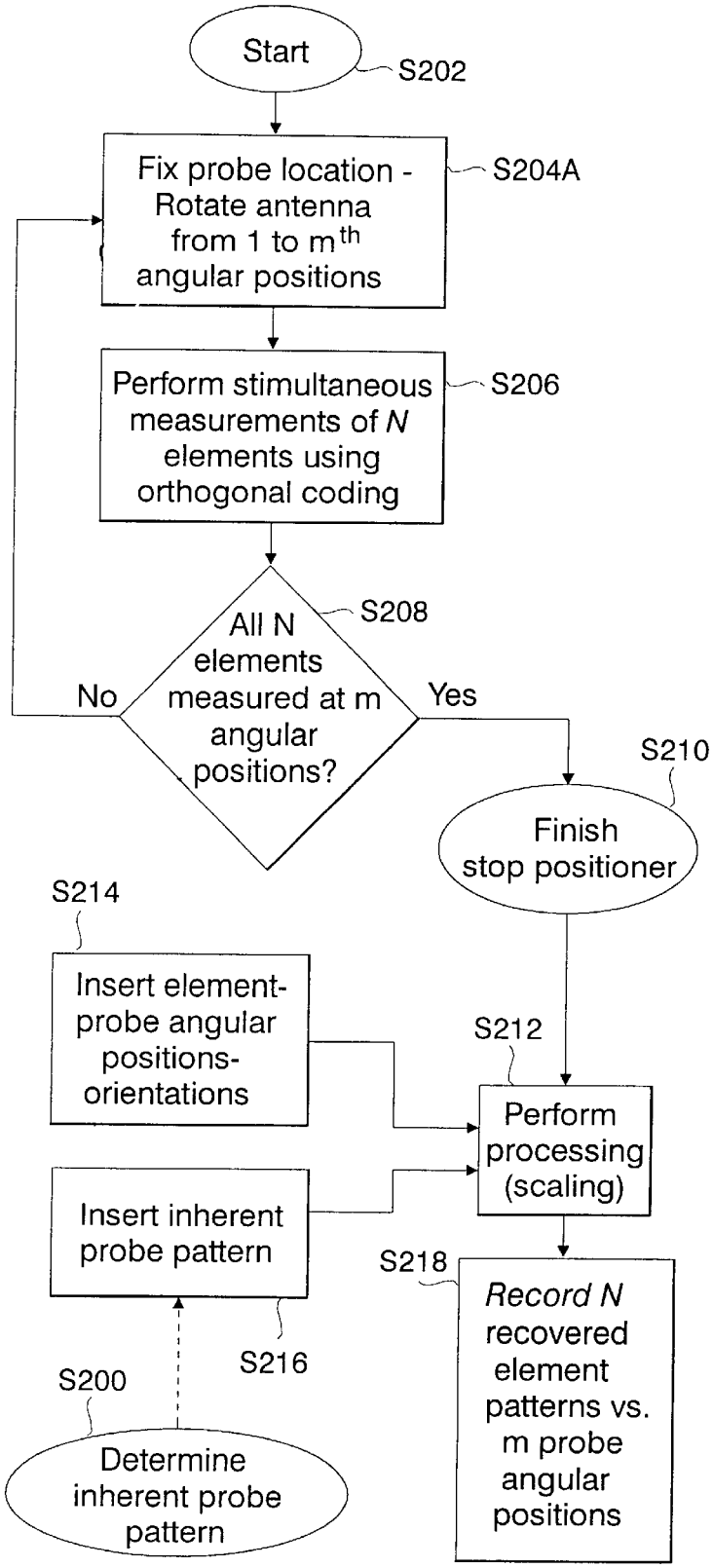
FIG. 2A is a method flow chart for an array antenna illustrating an embodiment of the present invention for characterizing element patterns where the antenna element probe is fixed and the antenna is rotated.

FIG. 2A is a flow chart which illustrates the method steps to obtain the resulting antenna element patterns 146 of the antenna elements 114, at a desired frequency and ambient temperature, when the probe 122 is fixed in position and the array antenna 100 is rotated by antenna positioner 126. Since the probe 122 has its own inherent amplitude and phase characteristic patterns, prior to starting the antenna element pattern characterization process, the probe's inherent amplitude and phase characteristic patterns are determined, resulting in a known probe pattern 144. Once the probe's inherent pattern has become known, the element pattern characterization is started, and at each probe-element position and orientation 142, an orthogonal encoding and decoding measurement set is performed. The desired element patterns 146 are reconstructed by performing multiple samples of the element patterns, and scaling the results by the appropriate probe-element distance and the known probe pattern 144.

First, step S200 allows for determining the probe's inherent amplitude and phase characteristic patterns. Then, start of operations begins in step S202, with the probe 122 in a fixed position opposite to, or in the vicinity of, and in front of one of N antenna elements 114 Step S204A allows for rotating the array antenna 100 around its phase center in the center of the aperture. Step S206 allows for performing simultaneous measurements of all N antenna elements 114 using the orthogonal coding 140 as described above, (a) when the array antenna 100 is a transmit antenna, the calibration signal emitted from the calibration RF source 102 is transmitted to the antenna beam ports 108 and (b) when the array antenna 100 is a receive antenna, the calibration signal emitted from the calibration RF source 102 is transmitted to the probe 122. Upon completing step S206, decision step S208 allows for proceeding to step S210 if all M element-probe angular positions have been measured. If not, the process returns to step S204A until all of the desired M element-probe angular positions have been measured.

Upon completion of the mth probe position, step S210 allows for finishing the measurements and stopping the antenna positioner 126. Step S212 allows for performing the processing (determining the scaling factors) for the antenna element positions by step S214 which allows for inserting the element-probe positions and orientations 142 and by step S216 which allows for inserting the inherent probe pattern 144 determined in step S200. Finally, step 218 allows for recording all of the N recovered antenna element patterns 146 versus the M antenna element positions and orientations 142.

Figure 2B:
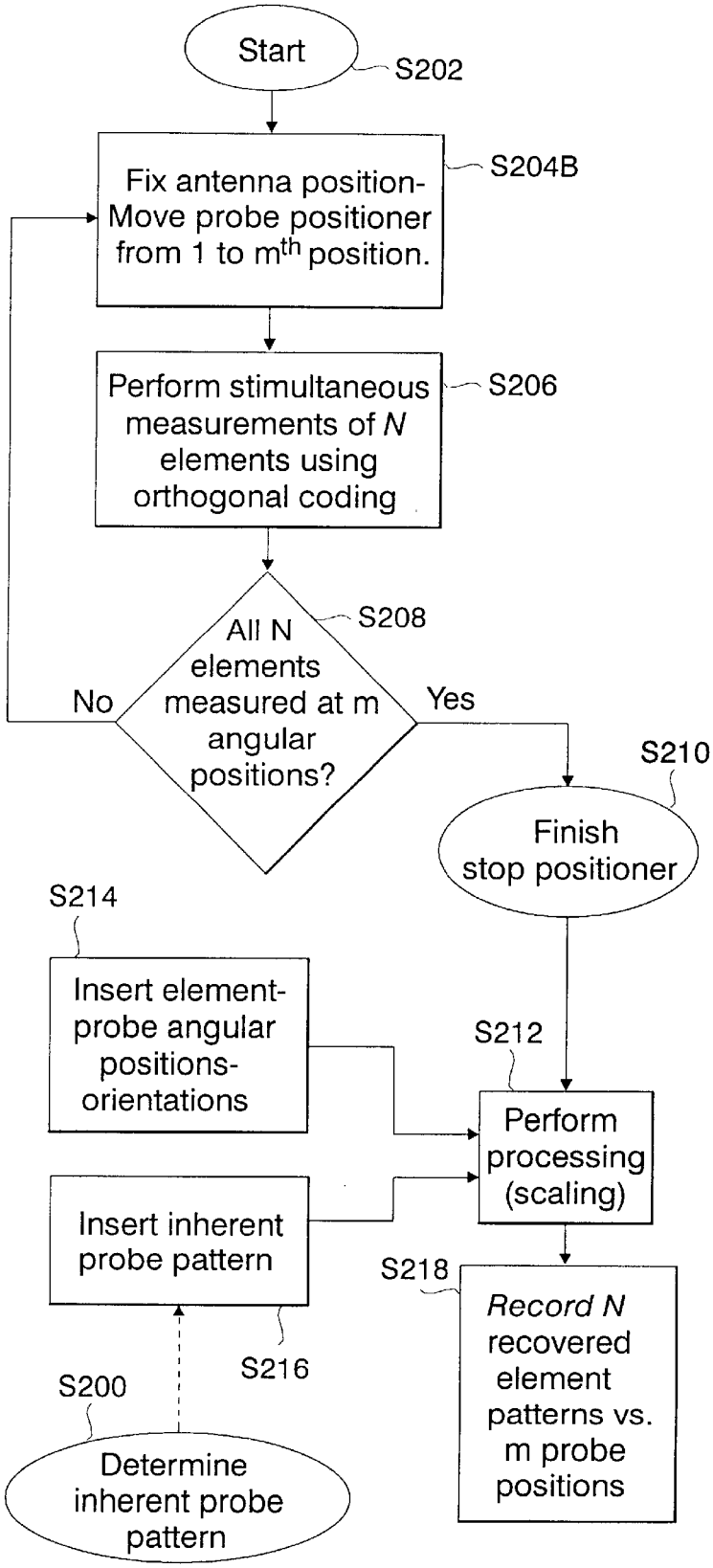
FIG. 2B is a method flow chart for an array antenna illustrating an embodiment of the present invention for characterizing element patterns where the antenna element probe is moved and the antenna is fixed.

FIG. 2B is a flow chart which illustrates the method steps to obtain the resulting antenna element patterns 146 of the antenna elements 114, again at a desired frequency and ambient temperature, as the probe 122 is moved along the positioner track 128 and the array antenna 100 is maintained in a fixed position. As is the case for the method steps illustrated in FIG. 2B, since the probe 122 has its own inherent amplitude and phase characteristic patterns, prior to starting the antenna element pattern characterization process, the probe's inherent amplitude and phase characteristic patterns are determined, resulting in a known probe pattern 144. Once the probe's inherent pattern 144 has become known, the element pattern characterization is started, and at each probe position 130, an orthogonal encoding and decoding measurement set is performed. The desired element patterns 146 are reconstructed by performing multiple samples of the element patterns, and scaling the results by the appropriate probe-element positions and orientations 142 and the known probe pattern 144.

Those skilled in the art will recognize that FIG. 2B illustrates the identical method steps as FIG. 2A, except that after Step 200 where the probe's inherent characteristics are determined and the start of operations begins in step S202, step S204B allows for moving the probe positioner 124 along the movement track 128 such that the probe 122 is positioned at the first of M positions opposite to, or in the vicinity of, and in front of one of N antenna elements 114. All remaining steps, beginning with step S206 are identical. Specifically, step S206 allows for performing simultaneous measurements of all N antenna elements 114 using the orthogonal coding 140 as described above, (a) when the antenna 100 is a transmit antenna, the calibration signal emitted from the calibration RF source 102 is transmitted to the antenna beam ports 108 and (b) when the antenna 100 is a receive antenna, the calibration signal emitted from the calibration RF source 102 is transmitted to the probe 122. Upon completing step S206, decision step S208 allows for proceeding to step S210 if all M probe positions 130 have been measured. If not, the process returns to step S204 until the probe 122 has been positioned at all of the desired M probe positions. 130.

Upon completion of the mth probe position, step S210 allows for finishing the measurements and stopping the probe positioner 120. Step S212 allows for performing the processing (determining the scaling factors) for the probe positions by step S214 which allows for inserting the element-probe positions and orientations 142 and by step S216 which allows for inserting the probe's inherent pattern 144 determined in step S200. Finally, step S218 allows for recording all of the N recovered antenna element patterns 146 versus the M antenna element angular positions.

Figure 2C:
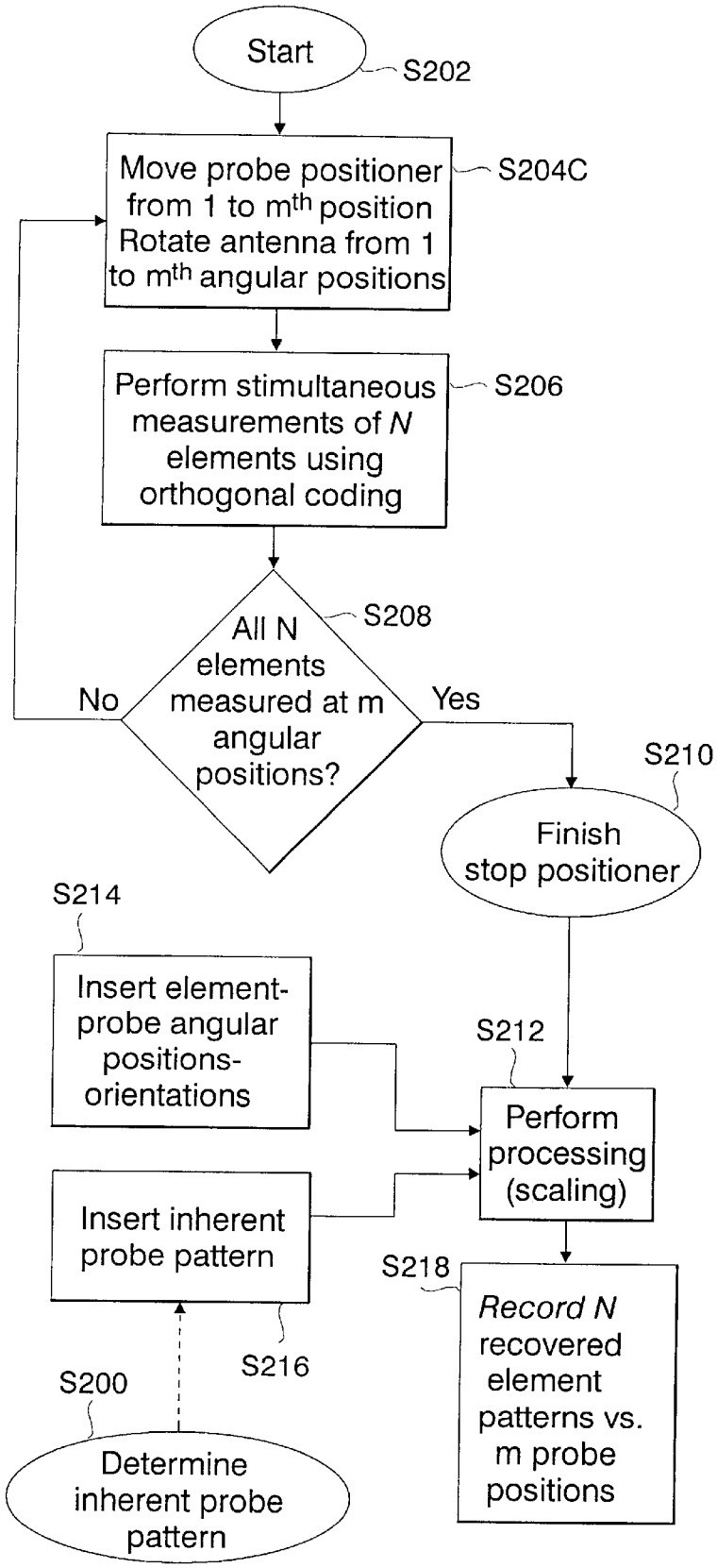
FIG. 2C is a method flow chart for an array antenna illustrating an embodiment of the present invention for characterizing element patterns where both the antenna element probe and the antenna are moved relative to each other.

FIG. 2C is a flow chart which illustrates the method steps to obtain the resulting antenna element patterns 146 of the antenna elements 114, also at a desired frequency and ambient temperature, as the probe 122 is moved along the positioner track 128 and the array antenna 100 is not maintained in a fixed position but is instead rotated by antenna positioner 126. Those skilled in the art will recognize that the method steps are identical to those described in FIG. 2A and FIG. 2B except that step S204C allows for moving the probe positioner 124 along the movement track 128 and rotating the array antenna 100 by the antenna positioner 126 such that the probe 122 is positioned at the first of M positions corresponding to the boresight position, or in the vicinity of, the boresight position and in front of one of N antenna elements 114.

For each of the method variations illustrated in FIG. 2A, FIG. 2B, and FIG. 2C, the processing of the signals received by the probe when in the transmit mode and received by the antenna elements when in the receive mode is performed by cross-correlating the received signals with the orthogonal codes, to produce the unprocessed signals, $E_1$, $E_2$, . . . , $E_n$, . . . , $E_N$. The complex weights are given by:

$$E_{\mathrm{nm}} = a_n e^{jk\phi n} g_n(\alpha^e_{\mathrm{nm}}) f(\alpha^p_{\mathrm{nm}}) \frac{\exp(jkr_{\mathrm{nm}})}{r_{\mathrm{nm}}}$$

where $r_{nm}$ is the distance between the n-th element and the m-th probe sample point, k is the wave number ($2\pi$/wavelength), $g_n(\alpha^e_{nm})$ is the n-th element pattern to be determined, $f(\alpha^p_{nm})$ is the probe pattern measured or predicted by calculation prior starting the process, $\alpha^e_{nm}$ defines the angles between the n-th antenna element boresight and the m-th probe direction, and $\alpha^p_{nm}$ defines the angles between the m-th antenna probe boresight position and the n-th antenna element.

The a priori knowledge of the antenna element patterns, the probe pattern, and the relative locations or positions of the various elements are used to compute a scaling factor $S_{nm}$ given by:

$$S_{nm} = \frac{r_{nm}\exp(-jkr_{nm})}{g_n(\alpha^e_{nm})f(\alpha^p_{nm})}$$

The relative amplitude and phase weights are then recovered using $$a_n e^{jk\phi n} = S_{nm}E_{nm}$$

The recovered amplitude and phase weights for each of the elements of the antenna array are then used in the conventional manner to calibrate the array, and to provide correction of the far-field pattern.

Figure 3:
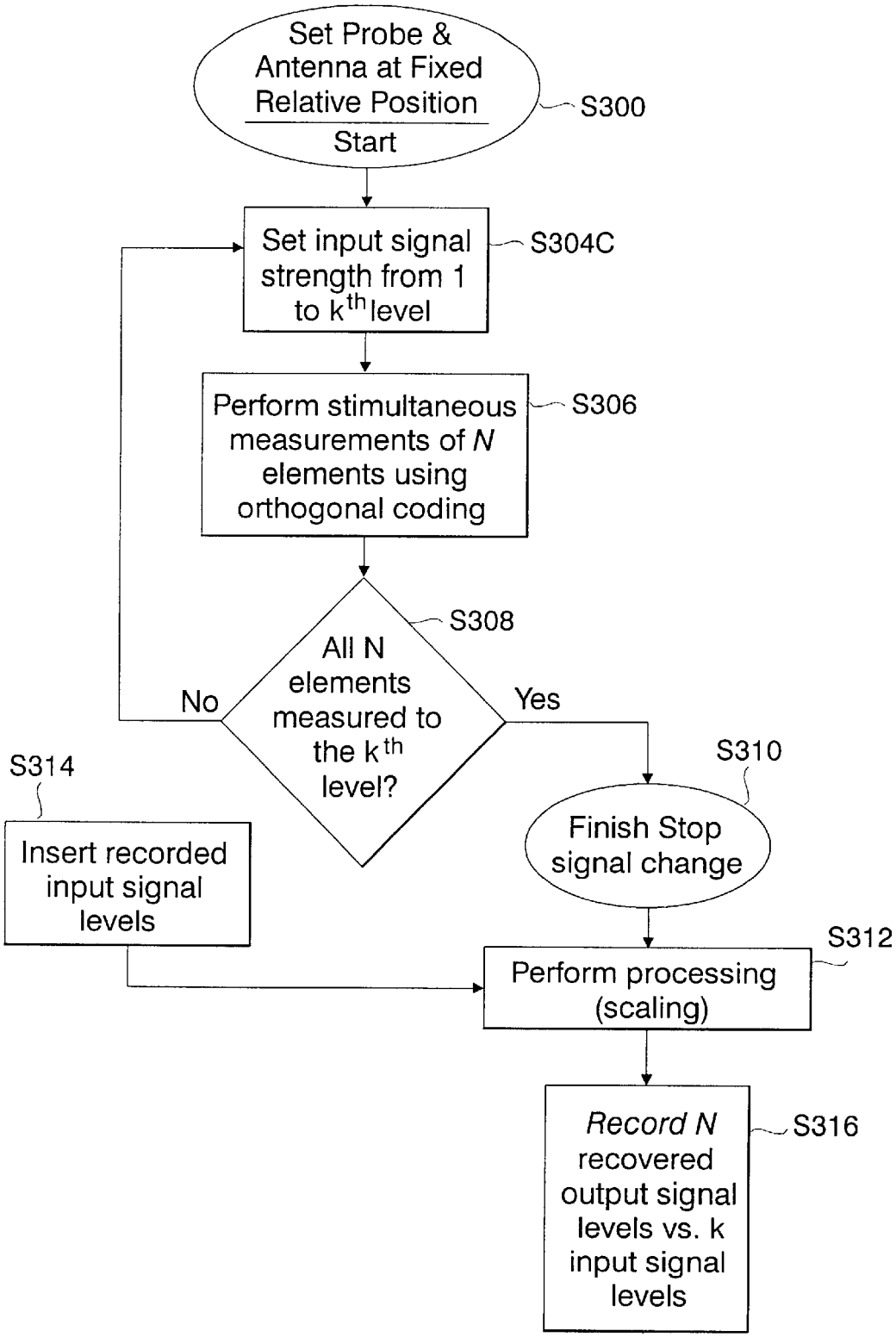
FIG. 3 is a method flow chart for an array antenna illustrating an embodiment of the present invention for characterizing amplifier characteristics.

FIG. 3 is a flow chart which illustrates the method steps to obtain the amplifier characteristics 150 of the antenna elements 114, at a desired frequency and ambient temperature, as the probe 122 is set at a fixed position relative to, and in front of, the array antenna 100 and nominally coincident with the boresight direction of the array antenna 100. Typically, it is desired to obtain the amplifier characteristics for an active transmit array antenna. In such a case, any of the arrangements of the systems illustrated in FIG. 1A, FIG. 1C, and FIG. 1E for the transmit mode can be used as long as during the measurements the probe 122 is set at a fixed position relative to the array antenna 100 and nominally coincident with the boresight direction of the array antenna 100. At the fixed probe position, an orthogonal encoding and decoding measurement set is performed. The desired amplifier characteristics are reconstructed by performing multiple samples of the signal levels; and scaling the results by the appropriate probe-element distance and known probe pattern determined before the start of the calibration procedure.

Step S300 allows for setting the probe 122 at a fixed position relative to array antenna 100 nominally coincident with the boresight direction of the array antenna 100. After start of operations in step S302, step S304 allows for setting the input signal strength to the kth level. Step S306 allows for performing simultaneous measurements of all N antenna elements 114 using the orthogonal coding 140 as described above. Upon completing step S306, decision step S308 allows for proceeding to step S310 if all N antenna elements 114 have been measured to the $k^{th}$ level. If not, the process returns to step S304 until all N antenna elements 114 have been measured to the $k^{th}$ level. Upon completion of the $k^{th}$ signal level, step S310 allows for finishing the measurements and stopping the changing of the signal levels. Step S312 allows for performing the processing by determining the scaling factors for the distances of the antenna elements 114 from the fixed probe position by step S314 which allows for inserting the recorded input signal levels 148. Finally, step S316 allows for recording all of the N recovered amplifier characteristics in the form of output signal levels 150 versus the K input signal levels 148.

Those skilled in the art will recognize that the method of recording the N recovered element patterns versus M probe positions at each element position as illustrated in FIG. 2A, 2B and 2C, where the antenna and probe are moved with respect to each other at various intervals during the measurement process, typically could not be performed at the same time as the method illustrated in FIG. 3 of recording the N recovered amplifier characteristics in the form of output signal levels 150 versus the K input signal levels 148 from the fixed probe position coincident with the boresight direction of the array antenna 100, where both the antenna and the probe are held in the same fixed positions during the entire measurement process.

In general, this process is very useful for obtaining antenna element patterns for use in conjunction with the above-mentioned near-field calibration system described by Lier et al. The arrangement for near-field calibration of the phase of the phase shifters, amplitude attenuators, or both, which are associated with each of the elements of the array 100 provides an improvement over the above-mentioned technique by Silverstein et al., because the Silverstein technique is a far-field measurement, and as such requires a remote site, and the need for coherent or synchronous reception, in conjunction with the remote site, in turn requires a communication path for synchronization, which introduces system complications. The scaling factors and recovered amplitude and phase weights for each of the elements of the antenna array are used in the conventional manner to calibrate the array, and to provide for correction of the far-field pattern. In addition the method would be useful for any other array antenna projects where one is interested in determining the antenna element patterns in the array environment.

In practice, the determination of the radiation patterns of the various elemental antennas of the array may require actual measurements of antenna elements located at representative positions in the array, as for example at the center and at the edges. Similarly, actual measurements may be required to determine the radiation pattern of the probe antenna.

EXAMPLE 1

In accordance with the system illustrated in FIG. 1B and the method described in FIG. 2B, an array of N=16 elements was placed parallel to the probe track which obtains field measurements of the sampled points at points 1 . . . M as shown. The output of the decoder provides a set of complex weights, $E_{nm}$, calculated as defined above. The scaling factor, $S_{nm}$, as defined above, contains the probe-element factor which, using the above procedure, is obtained from the measured data.

The technique was demonstrated using a 2×8 C-band test array in the transmit mode and a near-field positioner system to move the probe along various points along a linear track. The linear track was chosen due to availability and simplicity in determining the element-probe distances. Fifteen (15) elements were terminated and one element excited so that a set of single element measurements could be obtained. Using a network analyzer, the probe-element products were measured in a conventional way for a center element and an edge element. A distance of 4 feet (1.2 meters) between the probe track and the array was selected and the probe placed just in the far-field of the 7 inch (17.8 cm) horn apertures. Measurements were performed at a frequency of 4.0 GHz. The probe used was an open ended C-band (WR-229) waveguide.

Figure 4:
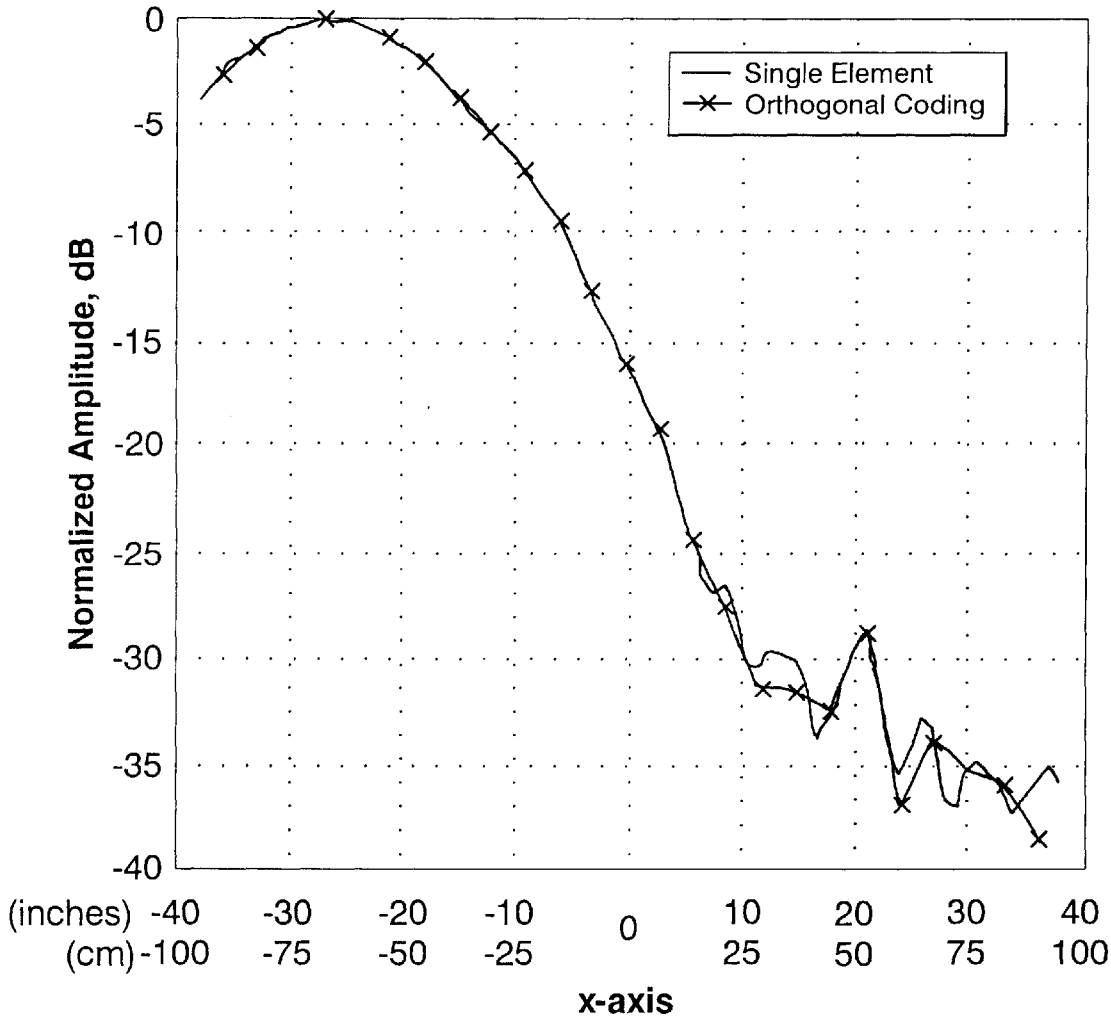
FIG. 4 is a graphical plot for a phased array antenna comparing the antenna element-probe product patterns for edge elements obtained by using the prior art technique of single element measurement to patterns obtained by using the orthogonal coding technique, as illustrated in FIG. 2B, of the present invention.
Figure 5:
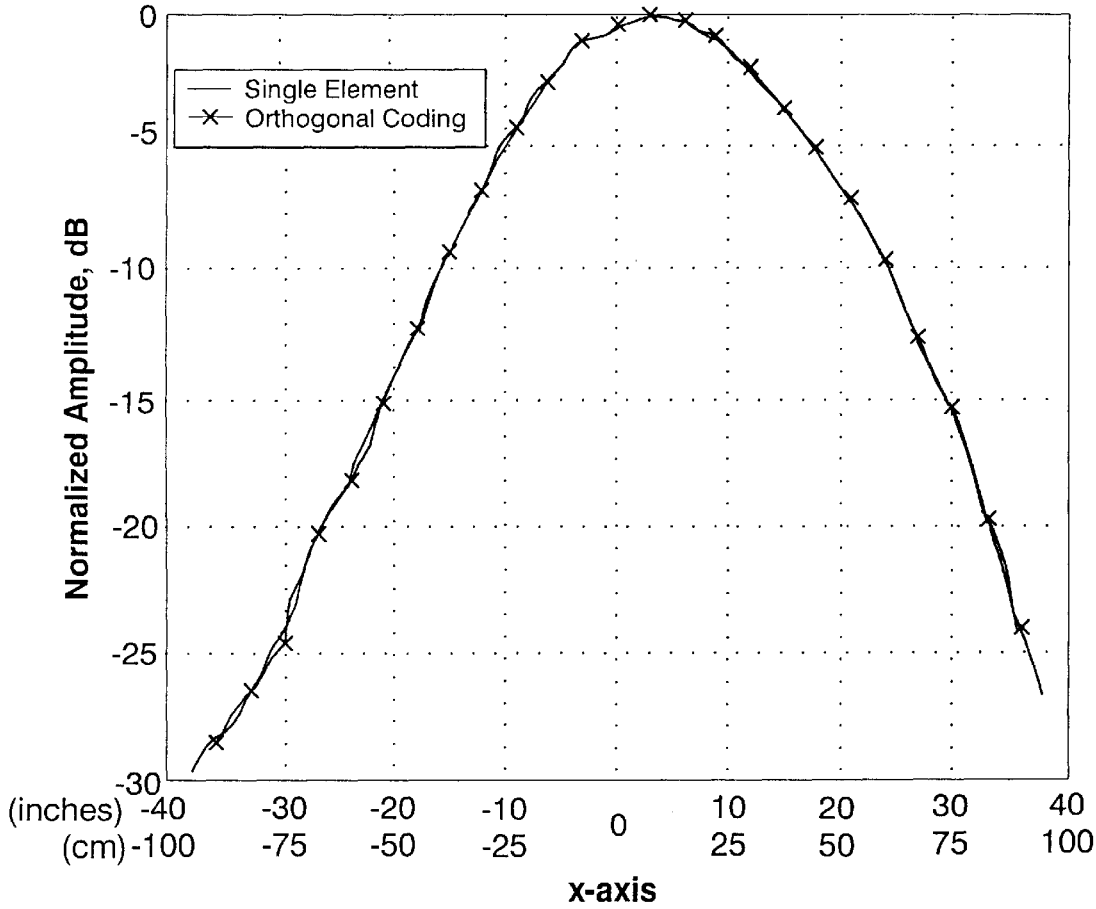
FIG. 5 is a graphical plot for a phased array antenna comparing the antenna element-probe product patterns for center elements obtained by using the prior art technique of single element measurement to patterns obtained by using the orthogonal coding technique, as illustrated in FIG. 2B, of the present invention.
Figure 6:
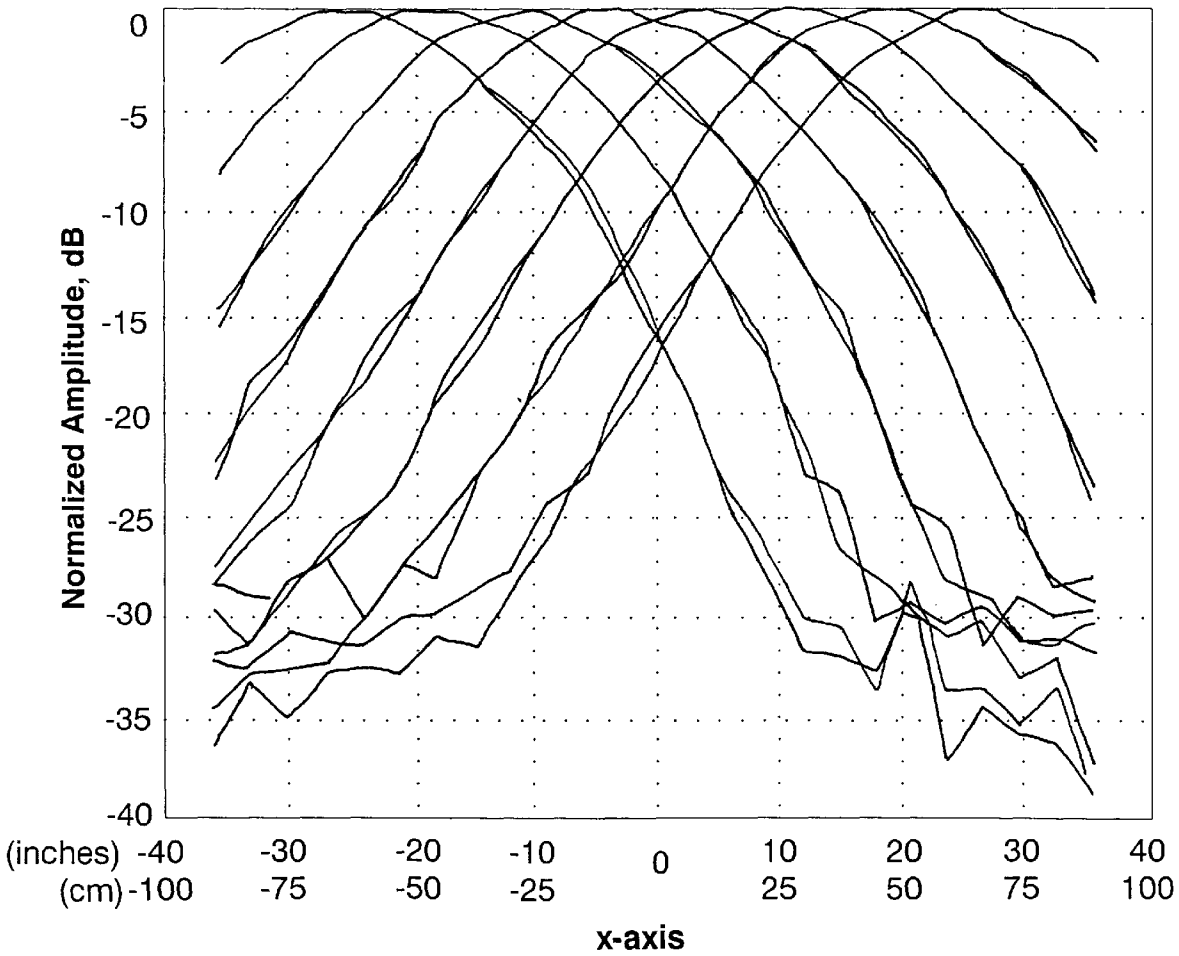
FIG. 6 is a graphical plot for a phased array antenna comparing the antenna element-probe product patterns for all 16 elements in a 2×8 array using the prior art technique to the antenna element-probe product patterns obtained using the orthogonal coding technique of the present invention as illustrated in FIG. 2B.

In FIG. 4 the measured results are illustrated for center elements obtained using both the single antenna element technique of the prior art and the orthogonal coding technique of the present invention as illustrated by FIG. 2B. Similarly, in FIG. 5 the measured results are illustrated for edge elements obtained using both the single antenna element technique of the prior art and the orthogonal coding technique of the present invention as illustrated by FIG. 2B. There is excellent agreement between both measurement methods for both the center and edge elements. FIG. 6 illustrates the results obtained for all 16 antenna elements, included on the same graph, again using the single antenna element technique of the prior art and the orthogonal coding technique of the present invention as illustrated in FIG. 2B; see D. S. Purdy, "An Automated Process for Efficiently Measuring the Patterns of All Elements Located in a Phased-Array Antenna," IEEE International Conference on Phased Array Systems and Technology, May 2000, Dana Point, Calif. The data in FIGS. 4, 5 and 6 illustrate the speed and efficiency by which the antenna element patterns can be obtained, since all 16 antenna elements were characterized simultaneously in only a few minutes, during just one probe-track movement set. Since all antenna elements were measured simultaneously, it was not necessary to disconnect and terminate the 15 antenna elements while exciting just one antenna element as is done using the prior art methods.

EXAMPLE 2

Figure 7:
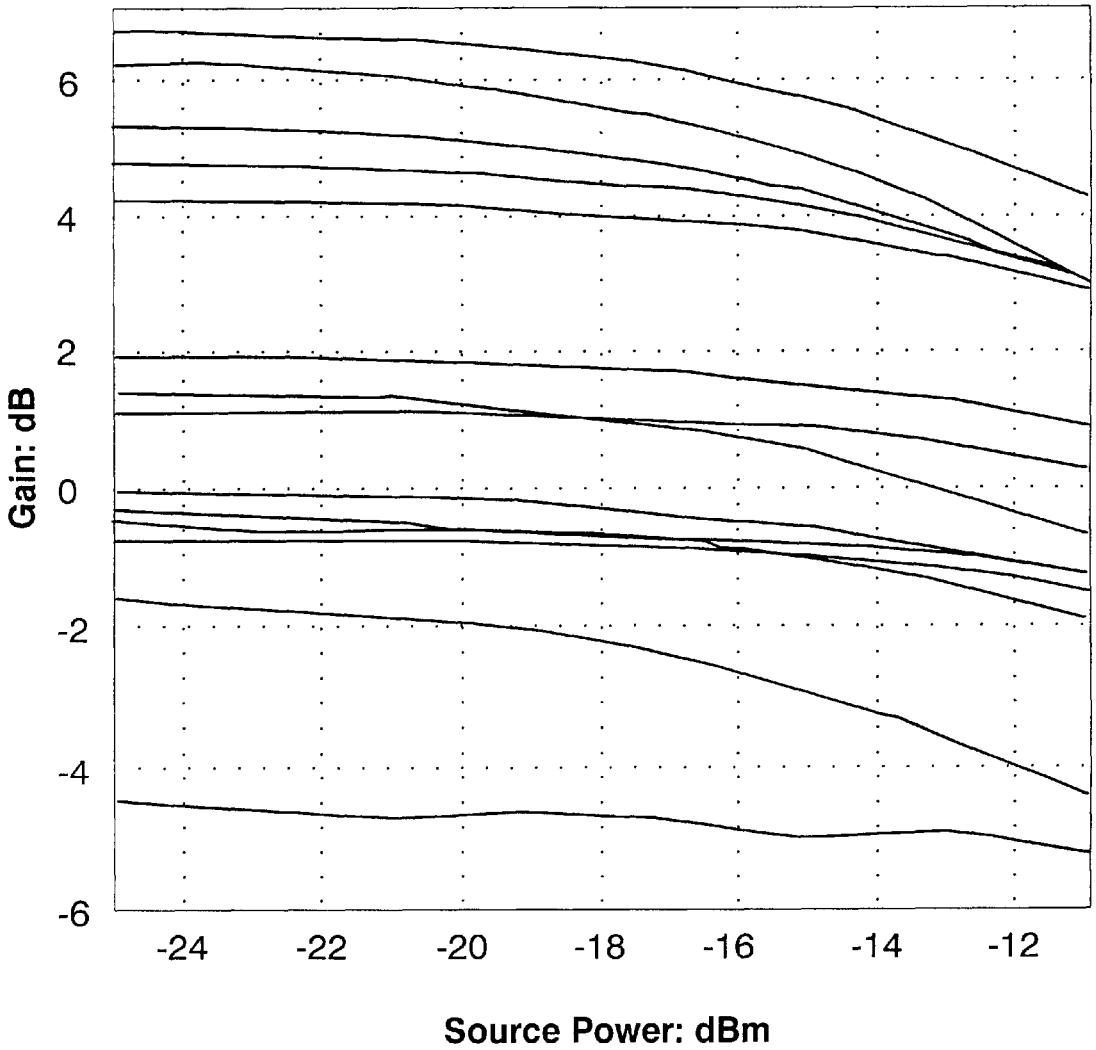
FIG. 7 is a graphical plot for a phased array antenna of the results obtained by the method for characterizing amplifier amplitude gain performance from CCE measurements, as illustrated in FIG. 3, of the present invention.

In FIG. 7, a graphical plot for an array antenna of the results obtained by the method of FIG. 3 for characterizing amplifier amplitude gain performance from CCE calibration measurements of the present invention is illustrated. The plots of FIG. 7 show the AM-to-AM curves or, equivalently, the output signal behavior versus input signal strength for 14 different elements in the array. The curves show a non-linear behavior of the amplifiers. Such non-linear characteristics can be analyzed by various models such as the Shimbo model referenced previously.

Figure 8:
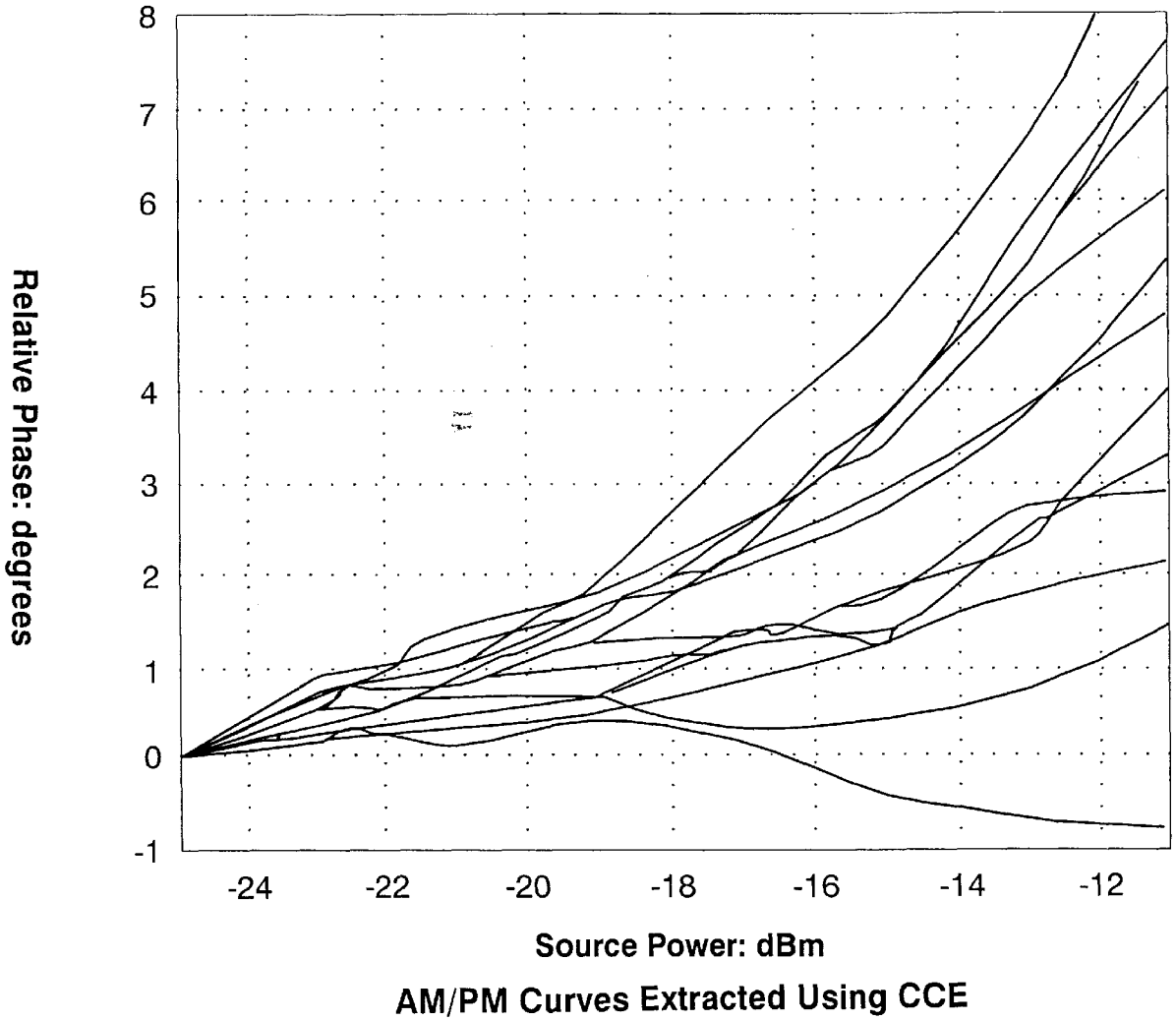
FIG. 8 is a graphical plot for a phased array antenna of the results obtained the method for characterizing amplifier relative phase performance from CCE calibration measurements, as illustrated in FIG. 3, of the present invention.

In FIG. 8, a graphical plot for a phased array antenna of the results obtained by the method of FIG. 3 for characterizing amplifier relative phase performance from CCE calibration measurements of the present invention is illustrated. The plots of FIG. 8 show the AM-to-PM curves or, equivalently, the output phase versus input signal strength for 14 different elements in the array. Such phase characteristics can be used in various models, again such as the Shimbo model referenced previously.

Therefore, using the apparatus as illustrated in FIG. 1A, 1B, 1C, 1D, 1E and 1F for recording the N elements at a fixed position nominally coincident with the boresight direction of the array antenna 100, it is possible to record N recovered output amplitude and phase signals of each antenna element and amplifier against signal level and frequency, and also ambient temperature of the spacecraft to compensate for the temperature variations between exposure to the sun and to the shade, which can vary as much as 30 to 40° C. This capability is crucial for rapid creation of "look-up" or calibration tables. In applications where the "CCE" calibration is being used, all hardware and almost all processing software are available to carry out the method, and the antenna elements can be characterized for such purposes as detecting failures while the satellite antenna is in orbit.

Concluding Remarks

In general, this process is very useful for obtaining antenna element patterns for use in conjunction with the above-mentioned near-field calibration system described by Lier et al. The arrangement for near-field calibration of the phase of the phase shifters, amplitude attenuators, or both, which are associated with each of the elements of the array 100 provides an improvement over the above-mentioned technique by Silverstein et al., because the Silverstein technique is a far-field measurement, and as such requires a remote site, and the need for coherent or synchronous reception, in conjunction with the remote site, in turn requires a communication path for synchronization, which introduces system complications. The scaling factors and recovered amplitude and phase weights for each of the elements of the antenna array are used in the conventional manner to calibrate the array, and to provide for correction of the far-field pattern. In addition the method would be useful for any other array antenna projects where one is interested in determining the antenna element patterns in the array environment.

In practice, the determination of the radiation patterns of the various elemental antennas of the array may require actual measurements of antenna elements located at representative positions in the array, as for example at the center and at the edges. Similarly, actual measurements may be required to determine the radiation pattern of the probe antenna.

Other embodiments of the invention will be apparent to those skilled in the art. For example, FIG. 1A and FIG. 1B illustrate calibration on only one of the transmit and receive antennas at a time because a single transmit antenna and a single receive antenna are illustrated in each figure. If there are plural transmit and receive antennas, some transmit antennas can be calibrated at the same time that receive antennas are being calibrated.

Those skilled in the art know that other methods can be used for generating sets of orthogonal coding sequences required for simultaneous measurements of the multiple antenna elements. While the described calibration arrangement is particularly advantageous for use in conjunction with the type of phased-array antennas mounted on spacecraft, it may be used on any kind of phased-array antenna.

The experimental data obtained using this current method of determining antenna element patterns is shown to compare well to the data collected using a single antenna element measurement technique. This current invention is especially useful for factory testing and diagnostic assessment of phased-arrays with a large number of antenna elements. This current method is easily automated and eliminates the need for manually removing cables and installing terminations.

Similarly, the method for characterizing amplifier properties "piggy-backs" on essentially the same hardware and similar software as the method for determining antenna element patterns and offers essentially the same advantages of speed and reduced parts integration and test time. Amplifier characterization is typically of interest for an "active" transmit array where "active" refers to the case where the amplifiers are distributed amplifiers located near the antenna elements.

The invention has now been explained with reference to specific embodiments. Other embodiments will be apparent to those of ordinary skill in the art in view of the foregoing description. It is not intended that this invention be limited except as indicated by the appended claims and their full scope equivalents.

What is claimed is:

1. A system for characterizing the patterns of a plurality of elements located in an array antenna, each of said plurality of elements including at least one of a (a) phase shifter and an (b) amplitude attenuator, in which said antenna includes a signal port for each individual beam which said array antenna generates, and a control signal input port to which control signals are applied for control of said phase shifters and amplitude attenuators, the plurality of elements therein comprising a beamformer, a plurality of said beamformers forming said array antenna, said system for characterizing the patterns of a plurality of elements located in said array antenna comprising:

a probe positioned within the field of said array antenna, positioning means for changing the relative position between said probe and said antenna, a calibration radio-frequency source, said calibration radio-frequency source being (a) coupled to at least one of the signal-ports of said array antenna when said array antenna is oriented as a transmit antenna, and (b) coupled to said probe when said array antenna is oriented as a receive antenna, said calibration radio-frequency source generating a calibration signal;

an orthogonal code generating means applied to a plurality of said antenna elements of said array antenna for sequentially setting at least one of said (a)phase shifters and (b)amplitude attenuators with a plurality of sets of values, each of the sets of values imposing a coding on said calibration signal to thereby sequentially generate calibration signals encoded with sets of values, each set of values so encoded onto said calibration signals being orthogonal to other sets of values with which said calibration signals are encoded, whereby, when said array antenna is oriented as a transmit antenna, said probe receives said calibration signals sequentially encoded with mutually orthogonal values, and when said array antenna is oriented as a receive antenna, said calibration signals sequentially encoded with mutually orthogonal values are generated at at least one of said signal ports of said array antenna;

a coherent radio-frequency receiver;

a decoder for decoding signals encoded with said mutually orthogonal values, for generating decoded signals therefrom;

encoded signal coupling means for coupling said encoded signals to said decoder as a result of which said decoder generates said decoded signals;

a processor coupled to said decoder, for processing said decoded signals for generating signals representing at least the values of one of phase shift and attenuation;

coupling means coupled to said processor and to at least one of said phase shifters and said amplitude attenuators, for coupling to said signals representing at least the values of one of phase shift and attenuation;

a recorder for recording said signals representing at least the values of one set of probe-element positions and element characterization patterns; and an antenna controller for controlling the relative position between said probe and said antenna and for controlling said orthogonal code generating means.

2. The system of claim 1 wherein said probe is positioned at at least one of (a) a distance fixed relative to said array antenna and (b) an orientation fixed relative to said array antenna.

3. The system of claim 1 wherein said probe is at a position corresponding essentially to the boresight position of one of said plurality of antenna elements.

4. The system of claim 1 wherein said probe is at a position corresponding essentially to the front of one of said plurality of antenna elements.

5. The system of claim 1 wherein said probe is at a position in the far field of said array antenna.

6. The system of claim 1 wherein said positioning means changes the position of said probe relative to said array antenna by rotation of said array antenna around a vertical axis which is one of (a) coincident with the centerline of said probe, and (b) parallel to,the centerline of said probe.

7. The system of claim 1 wherein said positioning means changes the position of said probe relative to said array antenna by translation of said array antenna to a position such that at least one of said beamformers remains parallel to the original position of said at least one beamformer.

8. The system of claim 1 wherein said positioning means changes the position of said probe relative to said array antenna by movement of said probe along a track.

9. The system of claim 1 wherein said antenna controller controls the positioning means for changing the position of said probe relative to said array antenna.

10. The system of claim 1, further comprising:

display means for displaying said at least the values of one set of probe-element positions and element characterization patterns so determined by said processor.

11. A system for determining the characteristics of a plurality of amplifiers in an array antenna, each amplifier coupled to an element located in said array antenna therein forming a plurality of elements, each of said plurality of elements including at least one of a (a) phase shifter and an (b) amplitude attenuator, in which said array antenna includes a beam port for each individual beam which said antenna generates, and a control signal input port to which control signals are applied for control of said phase shifters and amplitude attenuators, said plurality of elements therein comprising a beamformer, a plurality of said beamformers forming said array antenna, said system for determining the characteristics of a plurality of amplifiers located in said array antenna comprising:

a probe positioned at a position fixed relative to said array antenna, said probe being within the field of said array antenna, signal level changing means for changing the strength level of signals applied to a plurality of amplifiers located in any one of said beamformers of said array antenna;

a calibration radio-frequency source, said calibration radio-frequency source being (a) coupled to at least one of said signal ports of said array antenna when said array antenna is oriented as a transmit antenna, and (b) coupled to said probe when said array antenna is oriented as a receive antenna, said calibration radio-frequency source generating a calibration signal;

an orthogonal code generating means applied to a plurality of said antenna elements corresponding to any one of said beamformers for sequentially setting at least one of said (a)phase shifters and (b)amplitude attenuators with a plurality of sets of values, each of said sets of values imposing a coding on said calibration signal to thereby sequentially generate calibration signals encoded with sets of values, each set of values so encoded onto said calibration signals being orthogonal to other sets of values with which said calibration signals are encoded, whereby, when the array antenna is oriented as a transmit antenna, said probe receives said calibration signals sequentially encoded with mutually orthogonal values, and when said array antenna is oriented as a receive antenna, said calibration signals sequentially encoded with mutually orthogonal values are generated at at least one of said signal ports of said array antenna;

a coherent radio-frequency receiver;

a decoder for decoding signals encoded with said mutually orthogonal values, for generating decoded signals therefrom;

encoded signal coupling means for coupling said encoded signals to said decoder, as a result of which said decoder generates said decoded signals;

a processor coupled to said decoder, for processing said decoded signals for generating signals representing at least the values of one of phase shift and attenuation, coupling means coupled to, said processor and to at least one of said phase shifters and said amplitude attenuators, for processing said decoded signals for generating signals representing at least the values of at least one set of signal levels and amplifier characteristics;

a recorder for recording said signals representing at least the values of one set of probe element positions and orientations and amplifier characteristics; and an antenna controller for controlling said signal level changing means and said orthogonal code generating means.

12. The system of claim 11 wherein said probe is positioned at at least one of (a) a distance fixed relative to said array antenna and (b) an orientation fixed relative to said array antenna.

13. The system of claim 11 wherein said probe is at a position corresponding essentially to the boresight position of one of said plurality of antenna elements.

14. The system of claim 11 wherein said probe is at a position corresponding essentially to the front of one of said plurality of antenna elements.

15. The system of claim 11 wherein said probe is at a position in the far field of said array antenna.

16. The system of claim 11, further comprising display means for displaying at least the values of one set of signal levels and amplifier characteristics so determined by said processor.

17. The system of claim 11, wherein the property of an amplifier so determined is the output signal amplitude compared to the input signal amplitude.

18. The system of claim 11, wherein the property of an amplifier so determined is the relative phase between the output signal and the input signal.

19. A method for characterizing the patterns of a plurality of elements located in an array antenna, each of said plurality of elements including at least one of a (a) phase shifter and an (b) amplitude attenuator, in which said array antenna includes a signal port for each individual beam which said array antenna generates, and a control signal input port to which control signals are applied for control of said phase shifters and amplitude attenuators, the plurality of elements therein comprising a beamformer, a plurality of said beamformers forming said array antenna, said method for characterizing the patterns of a plurality of elements located in said array antenna comprising the steps of:

positioning a probe within the field of said array antenna, said probe and said array antenna fixed in position relative to each other;

generating a calibration signal by means of a calibration radio-frequency source, said calibration radio-frequency source being (a) coupled to at least one of the signal-ports of said array antenna when said array antenna is oriented as a transmit antenna, and (b) coupled to said probe when said array antenna is oriented as a receive antenna;

applying an orthogonal code generating means to a plurality of said antenna elements of said array antenna for sequentially setting at least one of said (a)phase shifters and (b)amplitude attenuators with a plurality of sets of values, each of the sets of values imposing a coding on said calibration signal to thereby sequentially generate calibration signals encoded with sets of values, each set of values so encoded onto said calibration signals being orthogonal to other sets of values with which said calibration signals are encoded, whereby, when said array antenna is oriented as a transmit antenna, said probe receives said calibration signals sequentially encoded with mutually orthogonal values, and when said array antenna is oriented as a receive antenna, said calibration signals sequentially encoded with mutually orthogonal values are generated at at least one of said signal ports of said array antenna;

receiving said calibration signals sequentially encoded with mutually orthogonal values by means of a coherent radio-frequency receiver;

decoding signals encoded with said mutually orthogonal values by means of a decoder for generating decoded signals therefrom;

coupling said encoded signals to said decoder as a result of which said decoder generates said decoded signals;

processing by means of a processor coupled to said decoder said decoded signals for generating signals representing at least the values of one of phase shift and if, attenuation;

coupling to said signals representing at least the values of one of phase shift and attenuation by coupling means coupled to said processor and to at least one of said phase shifters and said amplitude attenuators;

recording said signals representing at least the values of one set of probe-element positions and element characterization patterns by means of a recorder;

controlling by means of an antenna controller the relative position between said probe and said antenna, and said orthogonal coding means;

using orthogonal coding to perform simultaneous measurements comprising at least one of (a) phase angles, and (b) amplitude levels of said phase shifters and attenuators of said plurality of elements corresponding to said array antenna;

changing the relative position between said probe and said array antenna to a plurality of positions;

using orthogonal coding to perform simultaneous recorded measurements comprising at least one of (a) phase angles and (b) amplitude levels of the plurality of elements at each of the plurality of positions in the array antenna;

scaling the measurements of the relative probe element-probe positions by compensating for the pattern inherent to said probe, and recovering element patterns versus element-probe positions to characterize the patterns of elements of said array antenna.

20. The method of claim 19 further comprising the step of determining the pattern inherent to said probe with respect to said array antenna, therein yielding the inherent characteristic probe pattern.

21. The method of claim 19 wherein said probe is positioned at at least one of (a) a distance fixed relative to said array antenna and (b) an orientation fixed relative to said array antenna.

22. The method of claim 19 wherein said probe is at a position corresponding essentially to the boresight position of one of said plurality of antenna elements.

23. The method of claim 19 wherein said probe is at a position corresponding essentially to the front of one of said plurality of antenna elements.

24. The method of claim 19 wherein said probe is at a position in the far field of said array antenna.

25. The method of claim 19 wherein said positioning means changes the position of said probe relative to said array antenna by rotation of said array antenna around a vertical axis which is one of (a) coincident with the centerline of said probe, and (b) parallel to the centerline of said probe.

26. The method of claim 19 wherein said positioning means changes the position of said probe relative to said array antenna by translation of said array antenna to a position such that at least one of said beamformers remains parallel to the original position of said at least one beamformer.

27. The method of claim 19 wherein said positioning means changes the position of said probe relative to said array antenna by movement of said probe along a track.

28. The method of claim 19 further comprising the step of displaying said recovered element patterns versus element-probe positions and orientations.

29. A method for determining the characteristics of a plurality of amplifiers in an array antenna, each amplifier coupled to an element located in said array antenna therein forming a plurality of elements, each of said plurality of elements including at least one of a (a) phase shifter and an (b) amplitude attenuator, in which said array antenna includes a beam port for each individual beam which said antenna generates, and a control signal input port to which control signals are applied for control of said phase shifters and amplitude attenuators, said plurality of elements therein comprising a beamformer, a plurality of said beamformers forming said array antenna, said method for determining the characteristics of a plurality of amplifiers located in said array antenna comprising the steps of:

positioning a probe at a position fixed relative to said array antenna, said probe being within the field of said array antenna, applying signals of an initial strength level to a plurality of amplifiers located in any one of said beamformers of said array antenna;

generating a calibration signal by means of a calibration radio-frequency source, said calibration radio-frequency source being (a) coupled to at least one of said signal ports of said array antenna when said array antenna is oriented as a transmit antenna, and (b) coupled to said probe when said array antenna is oriented as a receive antenna;

applying an orthogonal code generating means to a plurality of said antenna elements corresponding to any one of said beamformers for sequentially setting at least one of said (a)phase shifters and (b)amplitude attenuators with a plurality of sets of values, each of said sets of values imposing a coding on said calibration signal to thereby sequentially generate calibration signals encoded with sets of values, each set of values so encoded onto said calibration signals being orthogonal to other sets of values with which said calibration signals are encoded, whereby, when the array antenna is oriented as a transmit antenna, said probe receives said calibration signals sequentially encoded with mutually orthogonal values, and when said array antenna is oriented as a receive antenna, said calibration signals sequentially encoded with mutually orthogonal values are generated at at least one of said signal ports of said array antenna;

receiving said calibration signals sequentially encoded with mutually orthogonal values by means of a coherent radio-frequency receiver;

decoding by means of a decoder signals encoded with said mutually orthogonal values, for generating decoded signals therefrom;

coupling by encoded signal coupling means said encoded signals to said decoder, as a result of which said decoder generates said decoded signals;

processing by means of a processor coupled to said decoder said decoded signals for generating signals representing at least the values of one of phase shift and attenuation, coupling to said processor and to at least one of said phase shifters and said amplitude attenuators, for processing said decoded signals for generating signals representing at least the values of at least one set of signal levels and amplifier characteristics;

recording by means of a recorder said signals representing at least the values of one set of probe element positions and orientations and amplifier characteristics;

controlling by means of an antenna controller said signal level changing means and said orthogonal code generating means in the case of a transmit antenna, setting the strength of the encoding signal to a plurality of signal input ports of said array antenna;

in the case of a receive antenna, setting the strength of said encoding signal to said probe;

using said orthogonal coding to perform simultaneous measurements comprising at least one of phase shift and attenuation of each amplifier corresponding to said plurality of elements in said array antenna;

changing the signal strength levels to a plurality of signal strength levels;

inserting recorded measurements of said input signal levels into said processor; and recovering recorded output signal levels versus input signal levels from said processor to determine the characteristics of a plurality of amplifiers in said array antenna.

30. The method of claim 29 wherein said probe is positioned at at least one of (a) a distance fixed relative to said array antenna and (b) an orientation fixed relative to said array antenna.

31. The method of claim 29 wherein said probe is at a position corresponding essentially to the boresight position of one of said plurality of antenna elements.

32. The method of claim 29 wherein said probe is at a position corresponding essentially to the front of one of said plurality of antenna elements.

33. The method of claim 29 wherein said probe is at a position in the far field of said array antenna.

34. The method of claim 29, further comprising the step of displaying at least the values of one set of signal levels and amplifier characteristics so determined by said processor.

35. The method of claim 29, wherein the property of an amplifier so determined is the output signal amplitude compared to the input signal amplitude.

36. The method of claim 29, wherein the property of an amplifier so determined is the relative phase between the output signal and the input signal.

* * * * *